US010576544B2

(12) United States Patent
Oxford

(10) Patent No.: US 10,576,544 B2
(45) Date of Patent: Mar. 3, 2020

(54) METHODS OF FORMING TRIGGERING ELEMENTS FOR EXPANDABLE APPARATUS FOR USE IN SUBTERRANEAN BOREHOLES

(71) Applicant: Baker Hughes, a GE company, LLC, Houston, TX (US)

(72) Inventor: James Andy Oxford, Magnolia, TX (US)

(73) Assignee: Baker Hughes, a GE company, LLC, Houston, TX (US)

( * ) Notice: Subject to any disclaimer, the term of this patent is extended or adjusted under 35 U.S.C. 154(b) by 71 days.

(21) Appl. No.: 15/591,292

(22) Filed: May 10, 2017

(65) Prior Publication Data

US 2017/0239727 A1 Aug. 24, 2017

Related U.S. Application Data

(62) Division of application No. 14/482,795, filed on Sep. 10, 2014, now Pat. No. 9,677,355, which is a division (Continued)

(51) Int. Cl.
*B22F 3/16* (2006.01)
*E21B 10/32* (2006.01)

(Continued)

(52) U.S. Cl.
CPC ..... *B22F 3/16* (2013.01); *B22F 1/025* (2013.01); *B22F 3/24* (2013.01); *B22F 7/008* (2013.01); *B22F 7/06* (2013.01); *B22F 7/08* (2013.01); *C22C 1/0408* (2013.01); *C22C 1/0491* (2013.01); *C22C 32/00* (2013.01); *E21B 10/322* (2013.01); *E21B 23/00* (2013.01); *E21B 33/1208* (2013.01); *B22F 2003/247* (2013.01); *B22F 2005/001* (2013.01);

(Continued)

(58) Field of Classification Search
CPC ... E21B 10/322; E21B 34/063; C22C 1/0408; C22C 21/06; C22C 1/0491
See application file for complete search history.

(56) References Cited

U.S. PATENT DOCUMENTS 1,678,075 A 7/1928 Phipps
2,069,482 A 2/1937 Seay (Continued)

FOREIGN PATENT DOCUMENTS

EP 246789 A2 11/1987
EP 0594420 A1 4/1994

(Continued)

OTHER PUBLICATIONS

International Preliminary Report on Patentability for International Application No. PCT/US2012/039372 dated Nov. 26, 2014, 5 pages.

(Continued)

*Primary Examiner* — Kipp C Wallace
(74) *Attorney, Agent, or Firm* — TraskBritt

(57) ABSTRACT

Expandable apparatus include a triggering element comprising an at least partially corrodible composite material. Methods are used to trigger expandable apparatus using such a triggering element and to form such triggering elements for use with expandable apparatus.

18 Claims, 13 Drawing Sheets

Related U.S. Application Data of application No. 13/116,875, filed on May 26, 2011, now Pat. No. 8,844,635.

(51) Int. Cl.

| | |
|---|---|
| ***B22F 7/08*** | (2006.01) |
| ***C22C 1/04*** | (2006.01) |
| ***C22C 32/00*** | (2006.01) |
| ***E21B 23/00*** | (2006.01) |
| ***B22F 1/02*** | (2006.01) |
| ***B22F 3/24*** | (2006.01) |
| ***B22F 7/00*** | (2006.01) |
| ***B22F 7/06*** | (2006.01) |
| ***E21B 33/12*** | (2006.01) |
| *B22F 5/00* | (2006.01) |
| *B28B 3/00* | (2006.01) |
| *E21B 7/28* | (2006.01) |

(52) U.S. Cl.

CPC ... *B22F 2301/052* (2013.01); *B22F 2301/058* (2013.01); *B22F 2301/15* (2013.01); *B22F 2301/20* (2013.01); *B22F 2302/253* (2013.01); *B22F 2998/10* (2013.01); *B28B 3/003* (2013.01); *E21B 7/28* (2013.01)

(56) References Cited

U.S. PATENT DOCUMENTS

| | | | | |
|---|---|---|---|---|
| 2,177,721 | A | 10/1939 | Johnson et al. | |
| 2,344,598 | A | 3/1944 | Church | |
| 2,754,089 | A | 7/1956 | Kammerer, Jr. | |
| 2,758,819 | A | 8/1956 | Kammerer, Jr. | |
| 2,834,578 | A | 5/1958 | Carr | |
| 2,882,019 | A | 4/1959 | Carr et al. | |
| 3,105,562 | A | 10/1963 | Stone et al. | |
| 3,123,162 | A | 3/1964 | Rowley | |
| 3,126,065 | A | 3/1964 | Chadderdon | |
| 3,211,232 | A | 10/1965 | Grimmer | |
| 3,224,507 | A | 12/1965 | Cordary, Jr. | |
| 3,425,500 | A | 2/1969 | Fuchs | |
| 3,433,313 | A | 3/1969 | Brown | |
| 3,556,233 | A | 1/1971 | Gilreath | |
| 3,645,331 | A | 2/1972 | Maurer et al. | |
| 4,403,659 | A | 9/1983 | Upchurch | |
| 4,458,761 | A | 7/1984 | Van Vreeswyk | |
| 4,491,022 | A | 1/1985 | de la Cruz | |
| 4,545,441 | A | 10/1985 | Williamson | |
| 4,589,504 | A | 5/1986 | Simpson | |
| 4,660,657 | A | 4/1987 | Furse et al. | |
| 4,690,229 | A | 9/1987 | Raney | |
| 4,693,328 | A | 9/1987 | Furse et al. | |
| 4,842,083 | A | 6/1989 | Raney | |
| 4,848,490 | A | 7/1989 | Anderson | |
| 4,854,403 | A | 8/1989 | Ostertag et al. | |
| 4,884,477 | A | 12/1989 | Smith et al. | |
| 4,889,197 | A | 12/1989 | Boe | |
| 4,945,947 | A | 8/1990 | Westra et al. | |
| 5,139,098 | A | 8/1992 | Blake | |
| 5,211,241 | A | 5/1993 | Mashaw et al. | |
| 5,224,558 | A | 7/1993 | Lee | |
| 5,265,684 | A | 11/1993 | Rosenhauch | |
| 5,293,945 | A | 3/1994 | Rosenhauch et al. | |
| 5,305,833 | A | 4/1994 | Collins | |
| 5,318,131 | A | 6/1994 | Baker | |
| 5,318,137 | A | 6/1994 | Johnson et al. | |
| 5,318,138 | A | 6/1994 | Dewey et al. | |
| 5,332,048 | A | 7/1994 | Underwood et al. | |
| 5,343,963 | A | 9/1994 | Bouldin et al. | |
| 5,361,859 | A | 11/1994 | Tibbitts | |
| 5,368,114 | A | 11/1994 | Tandberg et al. | |
| 5,375,662 | A | 12/1994 | Echols, III et al. | |
| 5,425,423 | A | 6/1995 | Dobson et al. | |
| 5,437,308 | A | 8/1995 | Morin et al. | |
| 5,553,678 | A | 9/1996 | Barr et al. | |
| 5,560,440 | A | 10/1996 | Tibbitts et al. | |
| 5,740,864 | A | 4/1998 | de Hoedt et al. | |
| 5,788,000 | A | 8/1998 | Maury et al. | |
| 5,823,254 | A | 10/1998 | Dobson et al. | |
| 5,887,655 | A | 3/1999 | Haugen et al. | |
| 6,024,915 | A * | 2/2000 | Kume | B22F 1/02 419/35 |
| 6,039,131 | A | 3/2000 | Beaton | |
| 6,059,051 | A | 5/2000 | Jewkes et al. | |
| 6,062,326 | A | 5/2000 | Strong et al. | |
| 6,109,354 | A | 8/2000 | Ringgenberg et al. | |
| 6,116,336 | A | 9/2000 | Adkins et al. | |
| 6,131,675 | A | 10/2000 | Anderson | |
| 6,189,631 | B1 | 2/2001 | Sheshtawy | |
| 6,213,226 | B1 | 4/2001 | Eppink et al. | |
| 6,227,312 | B1 | 5/2001 | Eppink et al. | |
| 6,289,999 | B1 | 9/2001 | Dewey et al. | |
| 6,325,151 | B1 | 12/2001 | Vincent et al. | |
| 6,378,632 | B1 | 4/2002 | Dewey | |
| 6,488,104 | B1 | 12/2002 | Eppink et al. | |
| 6,494,272 | B1 | 12/2002 | Eppink et al. | |
| 6,540,033 | B1 | 4/2003 | Sullivan et al. | |
| 6,615,933 | B1 | 9/2003 | Eddison | |
| 6,668,949 | B1 | 12/2003 | Rives | |
| 6,708,785 | B1 | 3/2004 | Russell et al. | |
| 6,732,817 | B2 | 5/2004 | Dewey et al. | |
| 7,048,078 | B2 | 5/2006 | Dewey et al. | |
| 7,314,099 | B2 | 1/2008 | Dewey et al. | |
| 7,389,828 | B2 | 6/2008 | Ritter et al. | |
| 7,395,882 | B2 | 7/2008 | Oldham et al. | |
| 7,513,318 | B2 | 4/2009 | Underwood et al. | |
| 7,900,717 | B2 | 3/2011 | Radford et al. | |
| 8,231,947 | B2 | 7/2012 | Vaidya et al. | |
| 8,235,144 | B2 | 8/2012 | Rasheed | |
| 8,297,364 | B2 | 10/2012 | Agrawal et al. | |
| 8,327,931 | B2 | 12/2012 | Agrawal et al. | |
| 8,403,037 | B2 | 3/2013 | Agrawal et al. | |
| 8,511,404 | B2 | 8/2013 | Rasheed | |
| 8,528,633 | B2 | 9/2013 | Agrawal et al. | |
| 8,528,668 | B2 | 9/2013 | Rasheed | |
| 8,820,439 | B2 | 9/2014 | Radford et al. | |
| 9,097,820 | B2 | 8/2015 | Rasheed | |
| 2002/0070052 | A1 | 6/2002 | Armell | |
| 2003/0029644 | A1 | 2/2003 | Hoffmaster et al. | |
| 2004/0119607 | A1 | 6/2004 | Davies et al. | |
| 2004/0134687 | A1 | 7/2004 | Radford et al. | |
| 2006/0249307 | A1 | 11/2006 | Ritter et al. | |
| 2007/0107908 | A1 | 5/2007 | Vaidya et al. | |
| 2007/0163808 | A1 | 7/2007 | Campbell et al. | |
| 2007/0181224 | A1 * | 8/2007 | Marya | C09K 8/805 148/400 |
| 2007/0205022 | A1 | 9/2007 | Treviranus et al. | |
| 2008/0128175 | A1 | 6/2008 | Radford et al. | |
| 2009/0084555 | A1 | 4/2009 | Lee | |
| 2010/0089583 | A1 * | 4/2010 | Xu | E21B 10/322 166/298 |
| 2010/0108394 | A1 | 5/2010 | Ollerenshaw et al. | |
| 2010/0252331 | A1 | 10/2010 | High et al. | |
| 2010/0270031 | A1 | 10/2010 | Patel | |
| 2010/0282511 | A1 | 11/2010 | Maranuk et al. | |
| 2010/0294510 | A1 * | 11/2010 | Holmes | E21B 41/00 166/376 |
| 2011/0073330 | A1 | 3/2011 | Radford | |
| 2011/0073376 | A1 | 3/2011 | Radford et al. | |
| 2011/0132143 | A1 | 6/2011 | Xu et al. | |
| 2011/0135530 | A1 | 6/2011 | Xu et al. | |
| 2011/0135953 | A1 | 6/2011 | Xu et al. | |
| 2011/0136707 | A1 | 6/2011 | Xu et al. | |
| 2011/0284233 | A1 | 11/2011 | Wu et al. | |
| 2012/0055714 | A1 | 3/2012 | Adam | |
| 2012/0111579 | A1 | 5/2012 | Radford et al. | |
| 2012/0298422 | A1 | 11/2012 | Oxford | |
| 2013/0333879 | A1 | 12/2013 | Rasheed | |
| 2014/0060933 | A1 | 3/2014 | Rasheed | |
| 2014/0374123 | A1 | 12/2014 | Oxford | |

(56) References Cited

U.S. PATENT DOCUMENTS

FOREIGN PATENT DOCUMENTS

| | | | |
|---|---|---|---|
| EP | 1036913 | A1 | 9/2000 |
| EP | 1044314 | A1 | 3/2005 |
| EP | 1614852 | A1 | 11/2006 |
| EP | 2327857 | B1 | 3/2014 |
| GB | 2328964 | A | 3/1999 |
| GB | 2344607 | A | 6/2000 |
| GB | 2319276 | B1 | 2/2001 |
| GB | 2353310 | A | 2/2001 |
| GB | 2344122 | B | 4/2003 |
| GB | 2393461 | B | 10/2006 |
| GB | 2426269 | B | 2/2007 |
| GB | 2441286 | B | 3/2008 |
| GB | 2438333 | B | 12/2008 |
| GB | 2437878 | B | 7/2009 |
| GB | 2446745 | B | 8/2009 |
| GB | 2460096 | A | 11/2009 |
| GB | 2420803 | B | 1/2010 |
| GB | 2465504 | A | 5/2010 |
| GB | 2465505 | A | 5/2010 |
| GB | 2449594 | B | 11/2010 |
| GB | 2476653 | A | 6/2011 |
| GB | 2455242 | B | 7/2011 |
| GB | 2470159 | B | 7/2012 |
| GB | 2473561 | B | 7/2012 |
| GB | 2479298 | B | 12/2013 |
| GB | 2521528 | A | 6/2015 |
| WO | 9736088 | A1 | 10/1997 |
| WO | 0031371 | A1 | 6/2000 |
| WO | 2008150290 | A1 | 12/2008 |
| WO | 2009156552 | A1 | 12/2009 |
| WO | 2011080640 | A2 | 7/2011 |
| WO | 2013166393 | A1 | 11/2013 |

OTHER PUBLICATIONS

International Search Report for International Application No. PCT/US2012/039372 dated Dec. 10, 2012, 3 pages.

International Written Opinion for International Application No. PCT/US2012/039372 dated Dec. 10, 2012, 4 pages.

Nie, Patents of Methods to Prepare Intermetallic Matrix Composites: A Review, Recent Patents on Materials Science (2008), Vo. 1, pp. 232-240.

U.S. Appl. No. 60/399,531, filed Jul. 30, 2002, titled Expandable Reamer Apparatus for Enlarging Boreholes While Drilling and Method of Use, to Radford et al.

* cited by examiner

100

METHODS OF FORMING TRIGGERING ELEMENTS FOR EXPANDABLE APPARATUS FOR USE IN SUBTERRANEAN BOREHOLES

CROSS-REFERENCE TO RELATED APPLICATIONS

This application is a divisional of U.S. patent application Ser. No. 14/482,795, filed Sep. 10, 2014, now U.S. Pat. No. 9,677,355, issued Jun. 13, 2017 which application is a divisional of U.S. patent application Ser. No. 13/116,875, filed May 26, 2011, now U.S. Pat. No. 8,844,635, issued Sep. 30, 2014, the disclosure of each of which is hereby incorporated herein in its entirety by this reference.

TECHNICAL FIELD

Embodiments of the present disclosure relate generally to corrodible triggering elements for use with tools used in a subterranean borehole and, more particularly, to corrodible triggering elements for use with an expandable reamer apparatus for enlarging a subterranean borehole and to corrodible triggering elements for use with an expandable stabilizer apparatus for stabilizing a bottom home assembly during a drilling operation and to related methods.

BACKGROUND

Expandable reamers are typically employed for enlarging subterranean boreholes. Conventionally, in drilling oil, gas, and geothermal wells, casing is installed and cemented to prevent the wellbore walls from caving into the subterranean borehole while providing requisite shoring for subsequent drilling operation to achieve greater depths. Casing is also conventionally installed to isolate different formations, to prevent cross-flow of formation fluids, and to enable control of formation fluids and pressure as the borehole is drilled. To increase the depth of a previously drilled borehole, new casing is laid within and extended below the previous casing. While adding additional casing allows a borehole to reach greater depths, it has the disadvantage of narrowing the borehole. Narrowing the borehole restricts the diameter of any subsequent sections of the well because the drill bit and any further casing must pass through the existing casing. As reductions in the borehole diameter are undesirable because they limit the production flow rate of oil and gas through the borehole, it is often desirable to enlarge a subterranean borehole to provide a larger borehole diameter for installing additional casing beyond previously installed casing as well as to enable better production flow rates of hydrocarbons through the borehole.

Expandable reamers may be used to enlarge a subterranean borehole and may include blades that are pivotably or hingedly affixed to a tubular body and actuated by way of a piston or by the pressure of the drilling fluid flowing through the body. For example, U.S. Pat. No. 7,900,717 to Radford et al. discloses an expandable reamer including blades that may be expanded by introducing a fluid restricting element such as a ball into the fluid flow path through the drill string. The ball may become trapped in a portion of the reamer, thereby, causing fluid pressure to build above the ball. The fluid pressure may then be used to trigger the expandable reamer and move the blades to an extended position for reaming. Other expandable apparatus, such as an expandable stabilizer may be triggered and expanded in a similar manner. However, in such expandable apparatus, the ball may not be removed from within the expandable apparatus without removing the entire drill string form the borehole. Accordingly, in many downhole operations, an expandable apparatus, which includes a ball triggering system, may be triggered only once during the downhole operation (e.g., drilling or reaming operation).

BRIEF SUMMARY

In some embodiments, the present disclosure includes expandable apparatus for use in a subterranean borehole. The expandable apparatus includes a tubular body having a longitudinal bore and at least one opening in a wall of the tubular body. The expandable apparatus further includes at least one member positioned within the at least one opening in the wall of the tubular body, the at least one member configured to move between a retracted position and an extended position and a triggering element comprising a composite material. The composite material comprises a discontinuous metallic phase dispersed within a corrodible matrix phase, the metallic phase comprising a metal or metal alloy, the corrodible matrix phase comprising at least one of a ceramic and an intermetallic compound.

In additional embodiments, the present disclosure includes methods of operating an expandable apparatus for use in a subterranean borehole. The methods include disposing a triggering element comprising an at least partially corrodible composite material in a fluid flow path passing through a longitudinal bore of a tubular body of the expandable apparatus, seating the tripping ball in a seat formed in the tubular body of the expandable apparatus, triggering the expandable apparatus comprising moving at least one member of the expandable apparatus from a retracted position to an extended position; at least partially corroding a portion of the triggering element to at least partially remove the triggering element from the seat, and moving the at least one member of the expandable apparatus from the extended position to the retracted position responsive at least in part to the at least partial removal of the triggering element.

Yet further embodiments of the present disclosure include methods of forming a triggering element for an expandable apparatus for use in a subterranean borehole. The methods include consolidating a powder comprising metallic particles coated with at least one of a ceramic and an intermetallic compound to form a solid three-dimensional body comprising a discontinuous metallic phase dispersed within a corrodible matrix phase, the metallic phase formed by the metallic particles, the corrodible matrix phase comprising the at least one of a ceramic and an intermetallic compound of the coating on the metallic particles and sizing and configuring the solid three-dimensional body to be received in a seat formed within the expandable apparatus.

DETAILED DESCRIPTION

The illustrations presented herein are, in some instances, not actual views of any particular earth-boring tool, expandable apparatus, triggering element, or other feature of an earth-boring tool, but are merely idealized representations that are employed to describe embodiments the present disclosure. Additionally, elements common between figures may retain the same numerical designation.

In some embodiments, the expandable apparatus described herein may be similar to the expandable apparatus described in U.S. Pat. No. 7,900,717 to Radford et al., which issued Mar. 8, 2011; U.S. patent application Ser. No. 12/570,464, entitled "Earth-Boring Tools having Expandable Members and Methods of Making and Using Such Earth-Boring Tools," and filed Sep. 30, 2009; U.S. patent application Ser. No. 12/894,937, entitled "Earth-Boring Tools having Expandable Members and Related Methods," and filed Sep. 30, 2010; U.S. Provisional Patent Application No. 61/411,201, entitled "Earth-Boring Tools having Expandable Members and Related Methods," and filed Nov. 8, 2010; U.S. patent application Ser. No. 13/025,884, entitled "Tools for Use in Subterranean Boreholes having Expandable Members and Related Methods," and filed Feb. 11, 2011, the disclosure of each of which is incorporated herein in its entirety by this reference.

Figure 1:
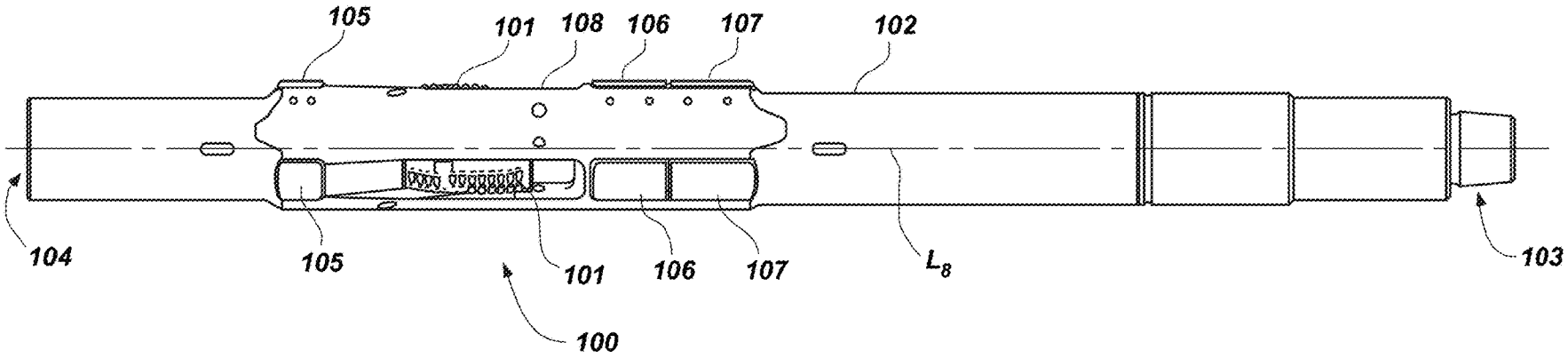
FIG. 1 is a side view of an expandable apparatus for use with a trigging element in accordance with an embodiment of the present disclosure.

An embodiment of an expandable apparatus (e.g., an expandable reamer apparatus 100) is shown in FIG. 1. The expandable reamer apparatus 100 may include a generally cylindrical tubular body 102 having a longitudinal axis $L_8$. The tubular body 102 of the expandable reamer apparatus 100 may have a distal end 103, a proximal end 104, and an outer surface 108. The distal end 103 of the tubular body 102 of the expandable reamer apparatus 100 may include a set of threads (e.g., a threaded male pin member) for connecting the distal end 103 to another section of a drill string or another component of a bottom-hole assembly (BHA), such as, for example, a drill collar or collars carrying a pilot drill bit for drilling a wellbore. Similarly, the proximal end 104 of the tubular body 102 of the expandable reamer apparatus 100 may include a set of threads (e.g., a threaded female box member) for connecting the proximal end 104 to another section of a drill string (e.g., an upper sub (not shown)) or another component of a bottom-hole assembly (BHA).

Figure 2:
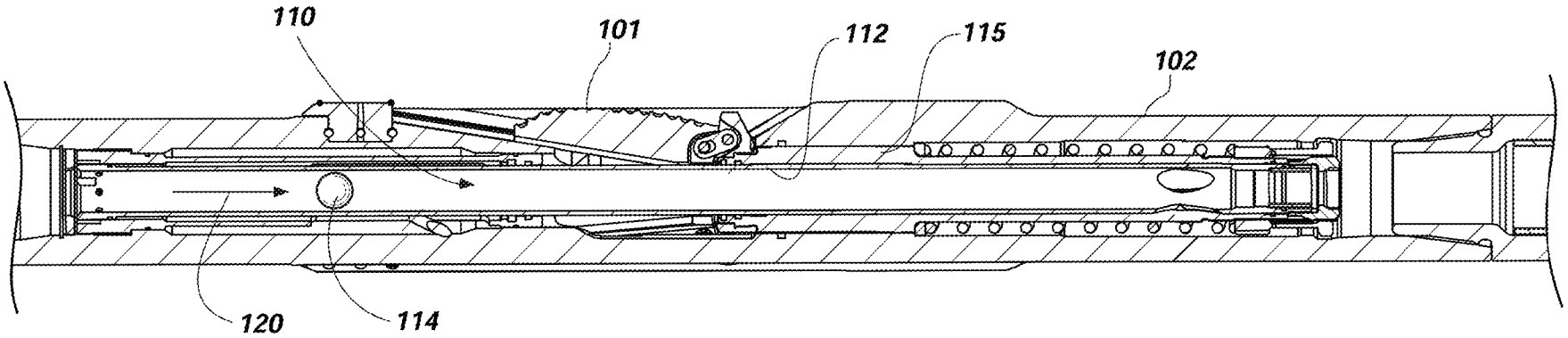
FIG. 2 shows a partial, longitudinal cross-sectional illustration of the expandable apparatus of FIG. 1 in a closed, or retraced, initial tool position including the triggering element therein.

Three sliding members (e.g., blades 101, stabilizer blocks, etc.) are positioned in circumferentially spaced relationship in the tubular body 102 and may be provided at a position along the expandable reamer apparatus 100 intermediate the first distal end 103 and the second proximal end 104. The blades 101 may be comprised of steel, tungsten carbide, a particle-matrix composite material (e.g., hard particles dispersed throughout a metal matrix material), or other suitable materials as known in the art. The blades 101 are retained in an initial, retracted position within the tubular body 102 of the expandable reamer apparatus 100 as illustrated in FIG. 2, but may be moved responsive to application of hydraulic pressure into the extended position (shown in FIG. 4) and moved into a retracted position when desired, as will be described herein. The expandable reamer apparatus 100 may be configured such that the blades 101 engage the walls of a subterranean formation surrounding a wellbore in which expandable reamer apparatus 100 is disposed to remove formation material when the blades 101 are in the extended position, but are not operable to engage the walls of a subterranean formation within a wellbore when the blades 101 are in the retracted position. While the expandable reamer apparatus 100 includes three blades 101, it is contemplated that one, two or more than three blades may be utilized to advantage. Moreover, while the blades 101 of expandable reamer apparatus 100 are symmetrically circumferentially positioned about the longitudinal axis $L_8$ along the tubular body 102, the blades may also be positioned circumferentially asymmetrically as well as asymmetrically about the longitudinal axis $L_8$. The expandable reamer apparatus 100 may also include a plurality of stabilizer pads to stabilize the tubular body 102 of expandable reamer apparatus 100 during drilling or reaming processes. For example, the expandable reamer apparatus 100 may include upper hard face pads 105, mid hard face pads 106, and lower hard face pads 107.

The expandable reamer apparatus 100 may be installed in a bottomhole assembly above a pilot bit and, if included, above or below the measurement while drilling (MWD)

device and incorporated into a rotary steerable system (RSS) and rotary closed loop system (RCLS), for example.

As shown in FIG. 2, before "triggering" the expandable reamer apparatus 100 to the expanded position, the expandable reamer apparatus 100 is maintained in an initial, retracted position. For example, a traveling sleeve 112 within a longitudinal bore 110 of the expandable reamer apparatus 100 may prevent inadvertent extension of blades 101. While the traveling sleeve 112 is held in the initial position, the blade actuating means is prevented from directly actuating the blades 101 whether acted upon by biasing forces or hydraulic forces. The traveling sleeve 112 may have, on its distal end, an enlarged end piece that holds a push sleeve 115 in a secured position, preventing the push sleeve 115 from moving upward under affects of differential pressure and activating the blades 101.

When it is desired to trigger the expandable reamer apparatus 100, drilling fluid flow is momentarily ceased, if required, and a triggering element 114 (e.g., a ball) comprising a corrodible composite material, as discussed below in greater detail, may be dropped into the drill string. The triggering element 114 moves in the downhole direction 120 under the influence of gravity, the flow of the drilling fluid, or a combination thereof.

Figure 3:
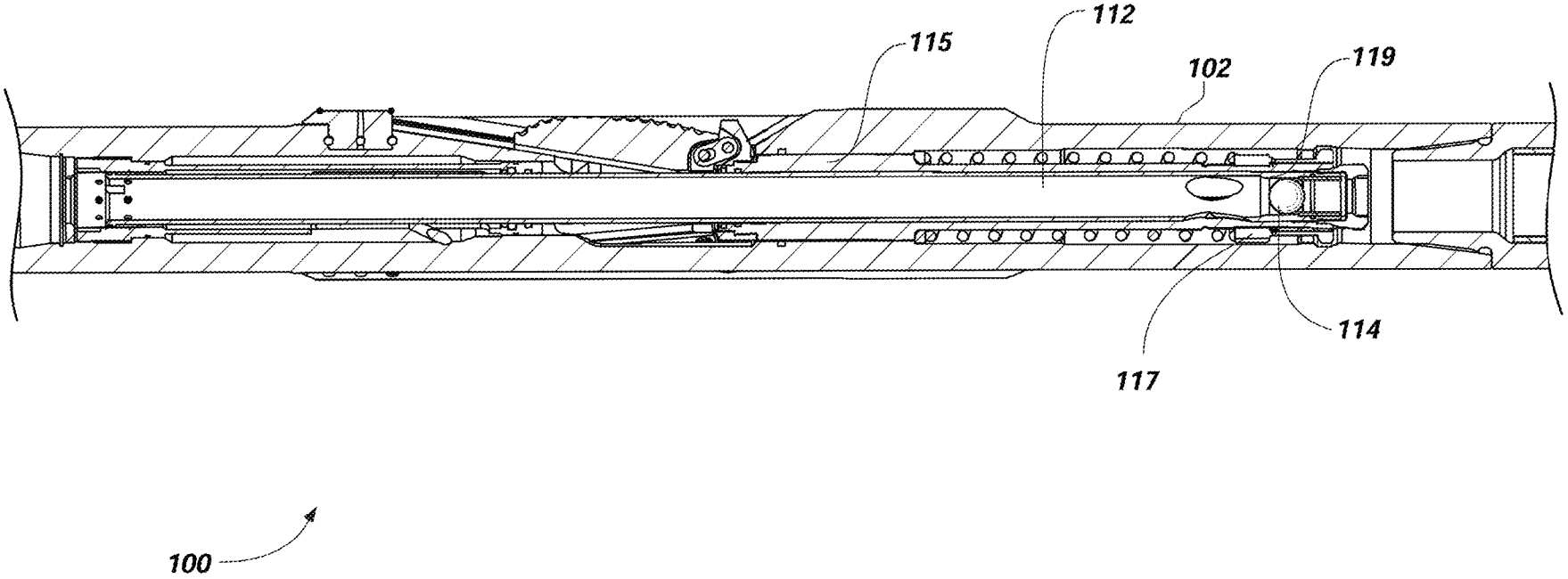
FIG. 3 shows a partial, longitudinal cross-sectional illustration of the expandable apparatus of FIG. 1 after the being at least partially triggered by the triggering element.

As shown in FIG. 3, the triggering element 114 reaches a seat in the expandable reamer apparatus 100 (e.g., the seat 119 formed in the traveling sleeve 112). The triggering element 114 decreases (e.g., stops) drilling fluid flow through the expandable reamer apparatus 100 and causes pressure to build above the triggering element 114 in the drill string. As the pressure builds, the triggering element 114 may be further seated into or against the seat 119 of the traveling sleeve 112 as the force of the drilling fluid on the triggering element 114 may deform the triggering element 114, the seat 119 of the traveling sleeve 112, or a combination thereof. At a predetermined pressure level, the traveling sleeve 112 may move downward. As the traveling sleeve 112 moves downward, a retaining element (e.g., latch sleeve 117) retaining the push sleeve 115, may be released (e.g., from engagement with the tubular body 102) enabling the push sleeve 115 to move within the tubular body 102.

Figure 4:
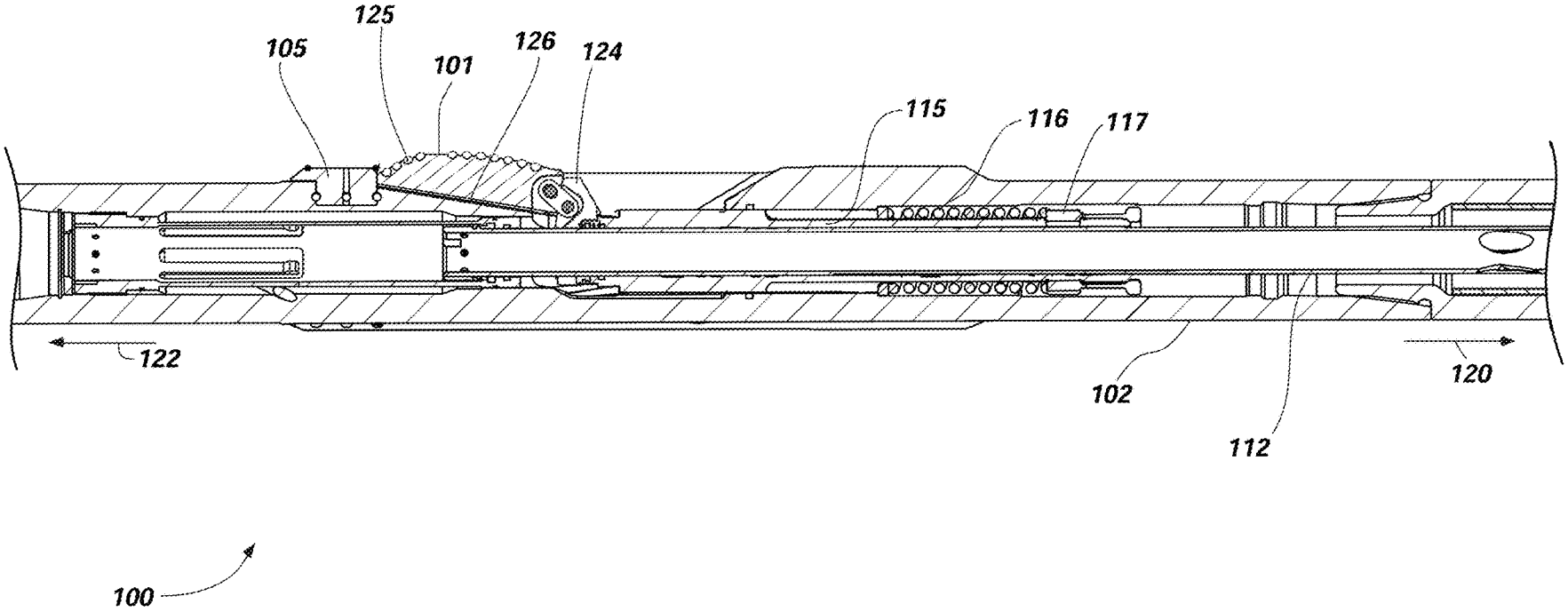
FIG. 4 shows a partial, longitudinal cross-sectional illustration of the expandable apparatus of FIG. 1 after the being at least partially triggered by the triggering element while a blade (one depicted) is moved to an extended position under the influence of fluid pressure.

Thereafter, as illustrated in FIG. 4, the pressure-activated push sleeve 115 may move in uphole direction 122 under fluid pressure influence through fluid ports as the traveling sleeve 112 moves in downhole direction 120. As the fluid pressure is increased the biasing force of the spring is overcome enabling the push sleeve 115 to move in the uphole direction 122. The push sleeve 115 is attached to a yoke 124, which is attached to the blades 101, which are now moved upwardly by the push sleeve 115. In moving upward, the blades 101 each follow a ramp or blade track 126 to which they are mounted.

The stroke of the blades 101 may be stopped in the fully extended position by upper hard faced pads 105 on the stabilizer block, for example. With the blades 101 in the extended position, reaming a borehole may commence. As reaming takes place with the expandable reamer apparatus 100, the mid and lower hard face pads 106, 107 may help to stabilize the tubular body 102 as cutting elements 125 of the blades 101 ream a larger borehole and the upper hard face pads 105 may also help to stabilize the top of the expandable reamer 100 when the blades 101 are in the retracted position.

When drilling fluid pressure is released, a spring 116 will help drive the push sleeve 115 with the attached blades 101 back downwardly and inwardly substantially to their original initial position (e.g., the retracted position), as shown in FIG. 3. Whenever the flow rate of the drilling fluid passing through the traveling sleeve 112 is elevated to or beyond a selected flow rate value, the push sleeve 115 with the yoke 124 and blades 101 may move upward with the blades 101 following the blade tracks 126 to again ream the prescribed larger diameter in a bore hole. Whenever the flow rate of the drilling fluid passing through the traveling sleeve 112 is below a selected flow rate value (i.e., the differential pressure falls below the restoring force of the spring 116), the blades 101 may retract, as described above, via the spring 116.

As mentioned above, the triggering element 114 (e.g., the ball) may comprise a corrodible composite material (e.g., comprising at least one a material that is at least partially corrodible as discussed below). For example, the corrodible composite material of the triggering element 114 may comprise a corrodible composite material as disclosed in one or more of U.S. patent application Ser. No. 12/633,682 filed Dec. 8, 2009 and entitled NANOMATRIX POWDER METAL COMPACT; U.S. patent application Ser. No. 12/633,686 filed Dec. 8, 2009 and entitled COATED METALLIC POWDER AND METHOD OF MAKING THE SAME; U.S. patent application Ser. No. 12/633,678 filed Dec. 8, 2009 and entitled METHOD OF MAKING A NANOMATRIX POWDER METAL COMPACT; U.S. patent application Ser. No. 12/633,683 filed Dec. 8, 2009 and entitled TELESCOPIC UNIT WITH DISSOLVABLE BARRIER; U.S. patent application Ser. No. 12/633,662 filed Dec. 8, 2009 and entitled DISSOLVABLE TOOL AND METHOD; U.S. patent application Ser. No. 12/633,677 filed Dec. 8, 2009 and entitled MULTI-COMPONENT DISAPPEARING TRIPPING BALL AND METHOD FOR MAKING THE SAME; U.S. patent application Ser. No. 12/633,668 filed Dec. 8, 2009 and entitled DISSOLVABLE TOOL AND METHOD; and U.S. patent application Ser. No. 12/633,688 filed Dec. 8, 2009 and entitled METHOD OF MAKING A NANOMATRIX POWDER METAL COMPACT, the disclosure of each of which is incorporated herein in its entirety by this reference.

Figure 5:
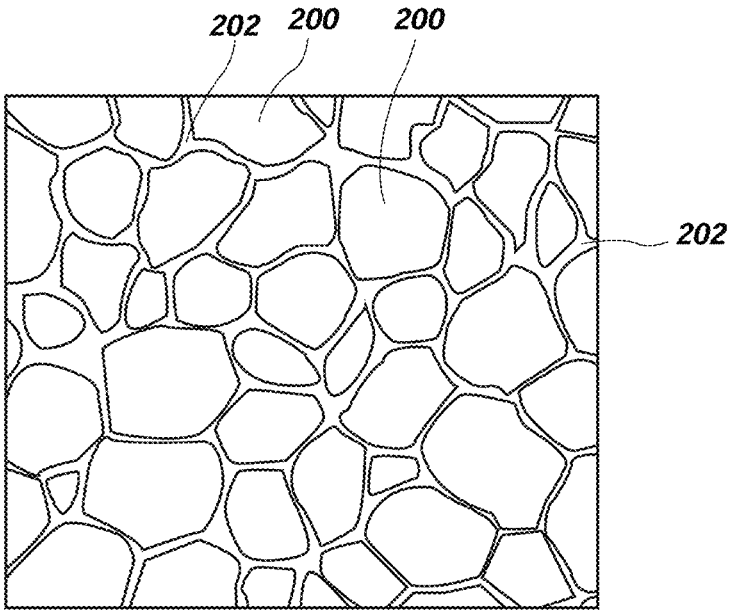
FIG. 5 schematically illustrates a corrodible composite material of a triggering element of an expandable apparatus such as the expandable apparatus of FIG. 1.
Figure 6:
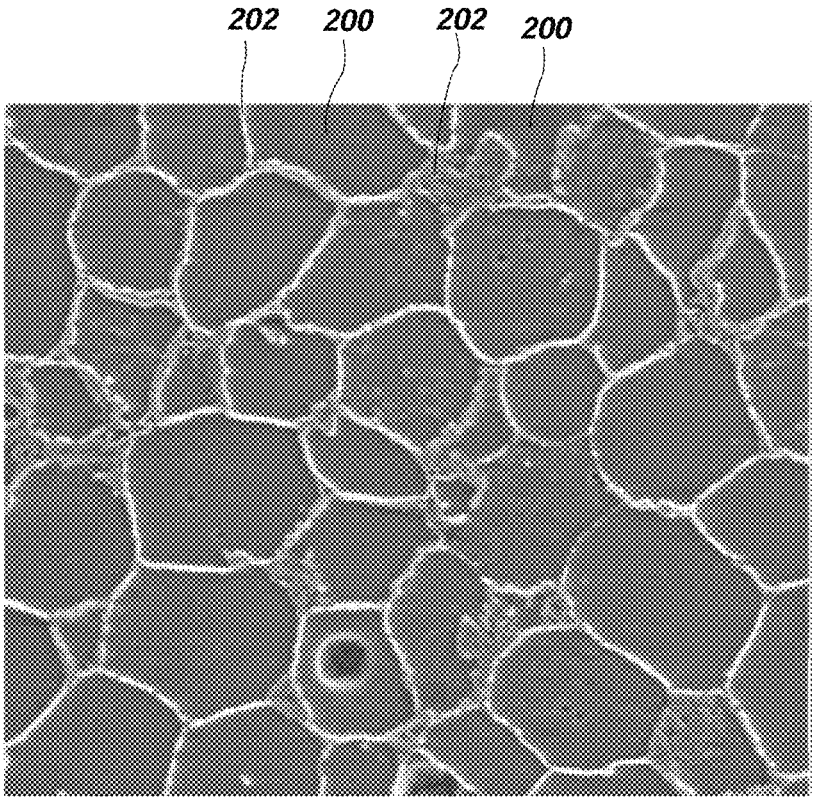
FIG. 6 is a photomicrograph of a corrodible composite material like that schematically illustrated in FIG. 5.

FIG. 5 schematically illustrates how a microstructure of a corrodible composite material of the triggering element 114 may appear under magnification. FIG. 6 is a micrograph showing how the microstructure of the resulting composite material may appear under magnification. As shown in FIG. 5, the composite material of the triggering element 114 may include a discontinuous metallic phase 200 dispersed within a corrodible matrix phase 202. In other words, the regions of the discontinuous metallic phase 200 may be cemented within and held together by the corrodible matrix phase 202.

The discontinuous metallic phase 200 may comprise a metal or metal alloy. In some embodiments, the metallic phase 200 may be formed from and comprise metal or metal alloy particles. Such particles may comprise nanoparticles in some embodiments. For example, the discontinuous regions of the metal or metal alloy may be formed from and comprise particles having an average particle diameter of about one hundred nanometers (100 nm) or less. In other embodiments, the discontinuous regions of the metal or metal alloy may be formed from and comprise particles having an average particle diameter of between about one hundred nanometers (100 nm) and about five hundred microns (500 μm), between about five microns (5 μm) and about three hundred microns (300 μm), or even between about eighty microns (80 μm) and about one hundred and twenty microns (120 μm).

Suitable materials for the discontinuous metallic phase 200 include electrochemically active metals having a standard oxidation potential greater than or equal to that of Zn.

For example, the discontinuous metallic phase 200 may comprise Mg, Al, Mn or Zn, in commercially pure form, or an alloy or mixture of one or more of these elements. The discontinuous metallic phase 200 also may comprise tungsten (W) in some embodiments. These electrochemically active metals are reactive with a number of common wellbore fluids, including any number of ionic fluids or highly polar fluids, such as those that contain salts, such as chlorides, and/or acid. Examples include fluids comprising potassium chloride (KCl), hydrochloric acid (HCl), calcium chloride ($CaCl_2$), calcium bromide ($CaBr_2$) or zinc bromide ($ZnBr_2$). Metallic phase 200 may also include other metals that are less electrochemically active than Zn.

The metallic phase 200 may be selected to provide a high dissolution or corrosion rate in a predetermined wellbore fluid, but may also be selected to provide a relatively low dissolution or corrosions rate, including zero dissolution or corrosion, where corrosion of the matrix phase 202 causes the metallic phase 200 to be rapidly undermined and liberated from the composite material at the interface with the wellbore fluid, such that the effective rate of corrosion of the composite material is relatively high, even though metallic phase 200 itself may have a low corrosion rate. In some embodiments, the metallic phase 200 may be substantially insoluble in the wellbore fluid.

Among the electrochemically active metals, Mg, either as a pure metal or an alloy or a composite material, may be particularly useful for use as the metallic phase 200, because of its low density and ability to form high-strength alloys, as well as its high degree of electrochemical activity. Mg has a standard oxidation potential higher than those of Al, Mn or Zn. Mg alloys that combine other electrochemically active metals, as described herein, as alloy constituents also may be particularly useful, including magnesium based alloys comprising one or more of Al, Zn, and Mn. In some embodiments, the metallic phase 200 may also include one or more rare earth elements such as Sc, Y, La, Ce, Pr, Nd and/or Er. Such rare earth elements may be present in an amount of about five weight percent (5 wt %) or less.

The metallic phase 200 may have a melting temperature ($T_P$). As used herein, $T_P$ means and includes the lowest temperature at which incipient melting occurs within the metallic phase 200, regardless of whether the metallic phase 200 is a pure metal, an alloy with multiple phases having different melting temperatures, or a composite of materials having different melting temperatures.

The corrodible matrix phase 202 has a chemical composition differing from that of the metallic phase 200. The corrodible matrix phase 202 may comprise at least one of a ceramic phase (e.g., an oxide, a nitride, a boride, etc.) and an intermetallic phase. In some embodiments, the corrodible matrix phase 202 may further include a metallic phase. For example, in some embodiments, the ceramic phase and/or the intermetallic phase of the corrodible matrix phase 202 may comprise at least one of an oxide, a nitride, and a boride of one or more of magnesium, aluminum, nickel, and zinc. If the corrodible matrix phase 202 includes a ceramic, the ceramic may comprise, for example, one or more of magnesium oxide, aluminum oxide, and nickel oxide. If the corrodible matrix phase 202 includes an intermetallic compound, the intermetallic compound may comprise, for example, one or more of an intermetallic of magnesium and aluminum, an intermetallic of magnesium and nickel, and an intermetallic of aluminum and nickel. The corrodible matrix phase 202 may comprise each of magnesium, aluminum, nickel, and oxygen in some embodiments. As a non-limiting example, the corrodible matrix phase 202 may comprise each of magnesium and oxygen, and may further include at least one of nickel and aluminum.

As a non-limiting example, in terms of elemental composition, the corrodible matrix phase 202 may comprise at least about fifty atomic percent (50 at %) magnesium some embodiments. The corrodible matrix phase 202 may further comprise from zero atomic percent (0 at %) to about twenty atomic percent (20 at %) aluminum, from zero atomic percent (0 at %) to about ten atomic percent (10 at %) nickel, and from zero atomic percent (0 at %) to about ten atomic percent (10 at %) oxygen.

The corrodible matrix phase 202 may have a melting temperature ($T_C$). As used herein, $T_C$ means and includes the lowest temperature at which incipient melting occurs within the corrodible matrix phase 202, regardless of whether the matrix phase 202 is a ceramic, an intermetallic, a metal, or a composite including one or more such phases.

The composite material of the triggering element 114 may have a composition that will enable the triggering element 114 to be maintained until it is no longer needed or required in the expandable apparatus 100, at which time one or more predetermined environmental conditions, such as a wellbore condition, including wellbore fluid temperature, pressure or pH value, may be changed to promote the removal of the triggering element 114 by at least partial dissolution. For example, the composite material of the triggering element 114 may have a composition that will corrode when exposed to solution (e.g., a solution provided in a drilling fluid) such as, for example, a salt solution (e.g., brine) and/or an acidic solution. Further, the corrosion mechanism may be or include an electrochemical reaction occurring between one or more reagents in the salt solution and/or acidic solution (i.e., a salt or an acid), and one or more elements of the corrodible matrix phase 202. As a result of the reaction between the one or more reagents in the salt solution and/or acidic solution and one or more elements of the corrodible matrix phase 202, the corrodible matrix phase 202 may degrade.

In some embodiments, the initiation of dissolution or disintegration of the body may decrease the strength of one or more portions of the triggering element 114 and may enable the triggering element 114 to fracture under stress. For example, mechanical stress from hydrostatic pressure and from a pressure differential applied across the triggering element 114 as it is seated against a seat in the expandable apparatus (e.g., the seat 119 formed by the traveling sleeve 112 of the expandable reamer apparatus 100 (FIG. 3)). The fracturing may break the triggering element 114 into small pieces that are not detrimental to further operation of the well, thereby negating the need to otherwise remove the triggering element 114 from the expandable apparatus or continue downhole operations with the triggering element 114 in place in the expandable apparatus.

Although the composite material of the triggering element 114 is corrodible, the composite material of the triggering element 114 may have an initial strength sufficiently high to be suitable for use in the expandable reamer apparatus 100. For example, in some embodiments, the composite material of the triggering element 114 may have an initial compressive yield strength of at least about 250 MPa prior to exposure to any corrosive environments. In some embodiments, the composite material of the triggering element 114 may have an initial compressive yield strength of at least about 300 MPa prior to exposure to any corrosive environments.

Further, in some embodiments, the composite material of the triggering element 114 may have a relatively low density.

For example, in some embodiments, the composite material of the triggering element 114 may have a density of about 2.5 g/cm$^3$ or less at room temperature, or even about 2.0 g/cm$^3$, 1.75 g/cm$^3$, or less at room temperature.

Although not shown in FIGS. 5 and 6, the composite material of the triggering element 114 optionally may further include additional reinforcing phases, such as particles including a carbide, boride, or nitride of one or more of tungsten, titanium, and tantalum.

Figure 7:
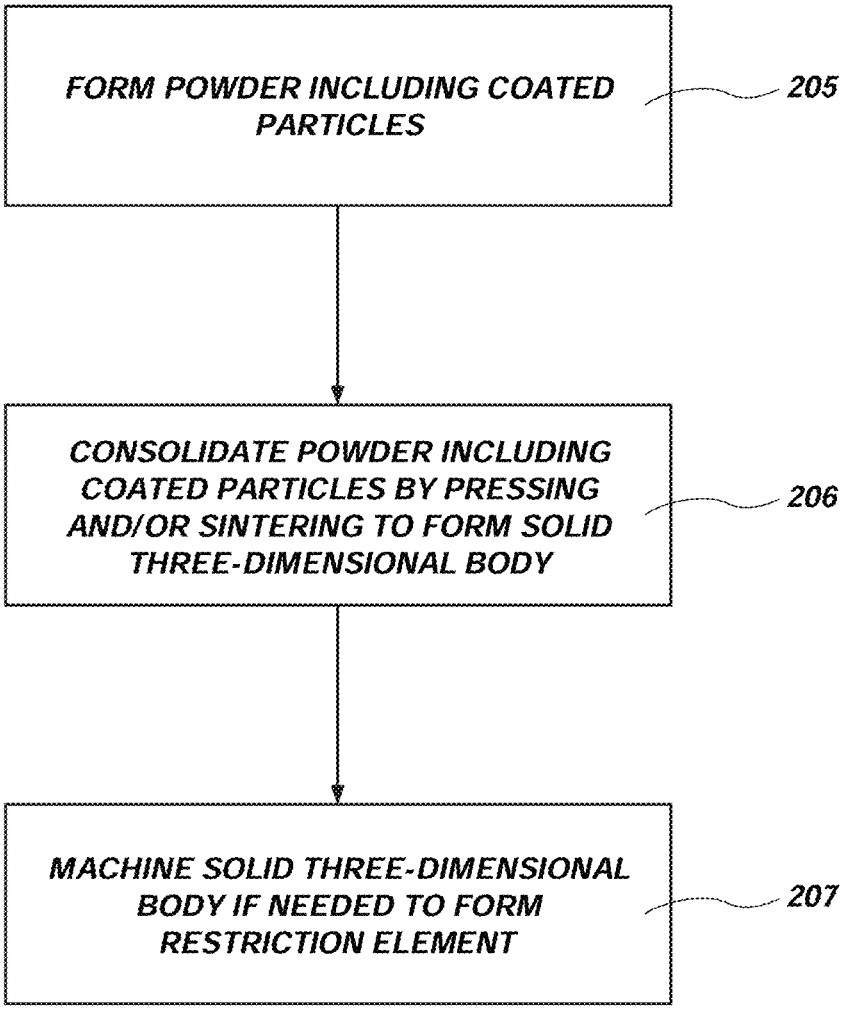
FIG. 7 is a flow chart illustrating an embodiment of a method that may be used to form a triggering element for use with an expandable apparatus like that shown in FIG. 1.

The composite material of the triggering element 114, and a method of forming the triggering element 114 comprising the composite material, is described below with reference to FIGS. 7 through 11. FIG. 7 is a flow chart illustrating an embodiment of a method that may be used to form the triggering element 114. Referring to FIG. 7, in action 205, a powder may be formed that includes coated particles. As discussed in further detail below, the particles may be used to form the discontinuous metallic phase 200 (FIG. 5) of the composite material of the triggering element 114, and the coating on the particles may be used to form the corrodible matrix phase 202 (FIG. 5) of the composite material of the triggering element 114.

Figure 8:
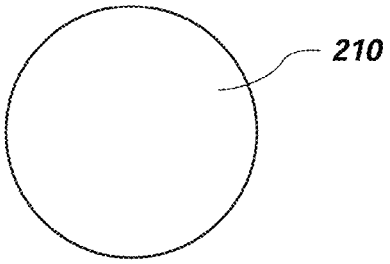
FIG. 8 schematically illustrates a metallic particle that may be used to form a triggering element for use with a expandable apparatus.
Figure 9:
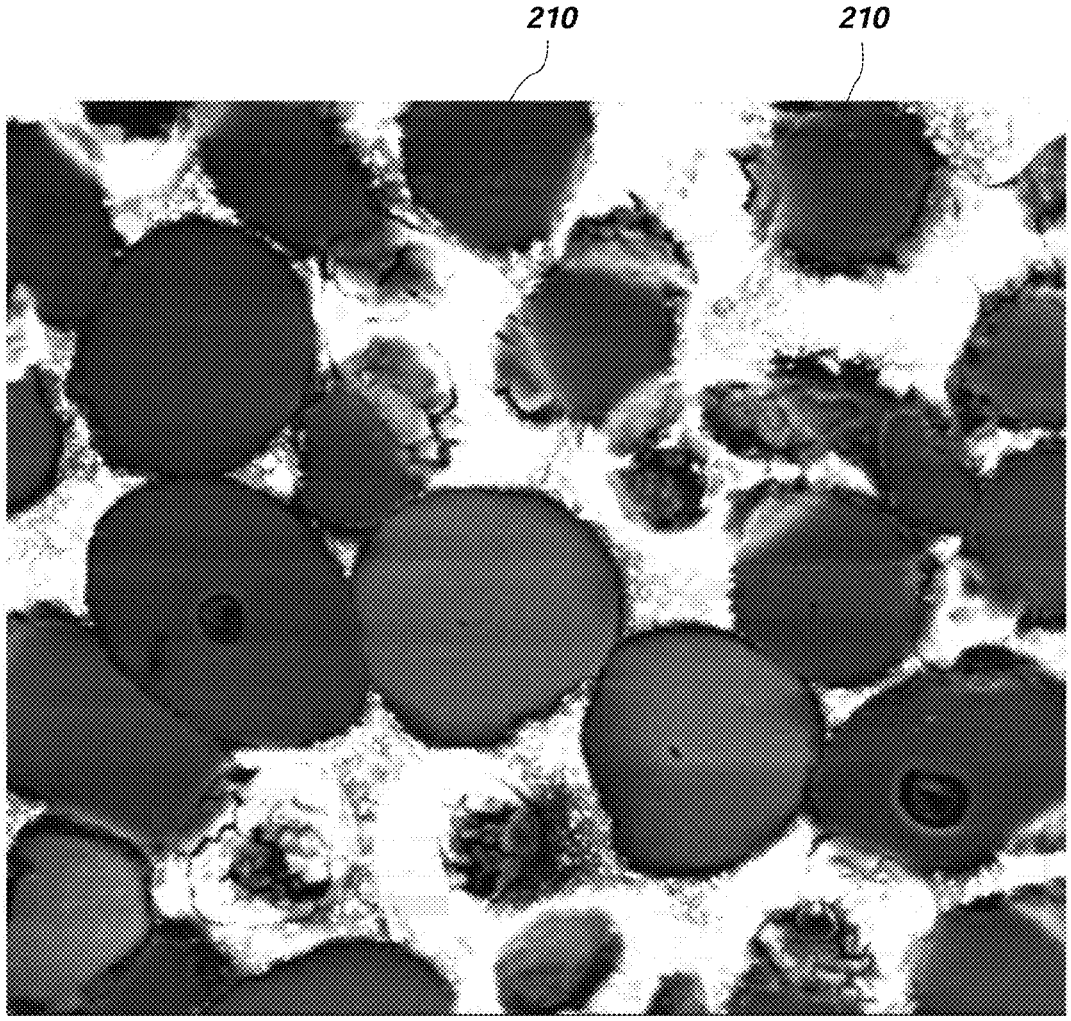
FIG. 9 is a photomicrograph of a plurality of metallic particles like that schematically illustrated in FIG. 8.

To form the powder, a plurality of particles like particle 210 schematically illustrated in FIG. 8 may be provided. In some embodiments, the particles 210 may comprise nanoparticles having an average particle diameter of about one hundred nanometers (100 nm) or less. In other embodiments, the particles 210 may have an average particle size (i.e., an average diameter) of between about one hundred nanometers (100 nm) and about five hundred microns (500 μm). Further, the particles 210 may have a mono-modal particle size distribution, or the particles 210 may have a multi-modal particle size distribution. The particles 210 may have a composition as previously described with reference to the discontinuous metallic phase 200 (FIG. 5). Although the particle 210 is schematically illustrated as being perfectly round in FIG. 8, in actuality, the particles 210 may not be perfectly round, and may have a shape other than round. FIG. 9 is a micrograph illustrating how the particles 210 may appear under magnification. As shown therein, the particles 210 (the dark shaded regions) may be of varying size and shape.

Figure 10:
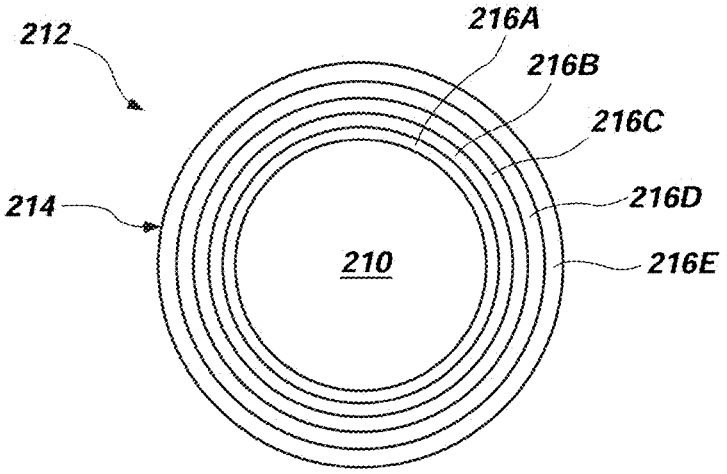
FIG. 10 schematically illustrates a particle like that of FIG. 8, but including a coating thereon comprising an oxide and/or an intermetallic compound, which may be used to form the corrodible composite material of a triggering element for use with an expandable apparatus like that shown in FIG. 1.

Referring to FIG. 10, the particles 210 may be coated with one or more materials to form coated particles 212, each of which includes a core comprising a particle 210 and a coating 214 thereon. As shown in FIG. 10, in some embodiments the coating 214 may comprise one or more layers 216A, 216B, . . . 216N, wherein N is any number. In the particular non-limiting embodiment shown in FIG. 10, the coating 214 includes five layers 216A-216E. The coating 214 may have a composition as previously described with reference to the corrodible matrix phase 202. In embodiments in which the coating 214 includes a plurality of layers 216A, 216B, . . . 216N, the layers 216A, 216B, . . . 216N may have the same or different individual compositions. In embodiments in which the layers 216A, 216B, . . . 216N may different individual compositions, each individual layer 216A, 216B, . . . 216N may have a composition as previously described with reference to the corrodible matrix phase 202.

In some embodiments, a first layer 216A may be selected to provide a strong metallurgical bond to the particle 210 and to limit interdiffusion between the particle 210 and the coating 214. A second layer 216B may be selected to increase a strength of the coating 214, or to provide a strong metallurgical bond and to promote sintering between adjacent coated particles 212, or both. Further, in some embodiments, one or more of the layers 216A, 216B, . . . 216N of the coating 214 may be selected to promote the selective and controllable dissolution or corrosion of the coating 214, and the matrix phase 202 (FIG. 5) resulting therefrom, in response to a change in a property within a drilling fluid in a wellbore. For example, any of the respective layers 216A, 216B, . . . 216N of the coating 214 may be selected to promote the selective and controllable dissolution or corrosion of the coating 214 in response to a change in a property within a drilling fluid in a wellbore.

Where the coating 214 includes a combination of two or more constituents, such as Al and Ni for example, the combination may include various graded or co-deposited structures of these materials, and the amount of each constituent, and hence the composition of the layer, may vary across the thickness of the layer.

In an example embodiment, the particles 210 include Mg, Al, Mn or Zn, or a combination thereof, and more particularly may include pure Mg or a Mg alloy, and the coating 214 includes an oxide, nitride, carbide, boride, or an intermetallic compound of one or more of Al, Zn, Mn, Mg, Mo, W, Cu, Fe, Si, Ca, Co, Ta, Re, and Ni.

In another example embodiment, the particles 210 include Mg, Al, Mn or Zn, or a combination thereof, and more particularly may include pure Mg or a Mg alloy, and the coating 214 includes a single layer of one or more of Al or Ni.

In another example embodiment, the particles 210 include Mg, Al, Mn or Zn, or a combination thereof, and more particularly may include pure Mg or a Mg alloy, and the coating 214 includes two layers 216A, 216B including a first layer 216A of aluminum and a second layer 216B of nickel, or a two-layer coating 214 including a first layer 216A of aluminum and a second layer 216B of tungsten.

In another example embodiment, the particles 210 include Mg, Al, Mn or Zn, or a combination thereof, and more particularly may include pure Mg or a Mg alloy, and the coating 214 includes three layers 216A, 216B, 216C. The first layer 216A includes one or more of Al and Ni. The second layer 216B includes an oxide, nitride, or carbide of one or more of Al, Zn, Mg, Mo, W, Cu, Fe, Si, Ca, Co, Ta, Re and Ni. The third layer 216C includes one or more of Al, Mn, Fe, Co, and Ni.

In another example embodiment, the particles 210 include commercially pure Mg, and the coating 214 includes three layers 216A, 216B, 216C. The first layer 216A comprises commercially pure Al, the second layer 216B comprises aluminum oxide ($Al_2O_3$), and the third layer 216C comprises commercially pure Al.

In another example embodiment, the particles 210 include Mg, Al, Mn or Zn, or a combination thereof, and more particularly may include pure Mg or a Mg alloy, and the coating 214 includes four layers 216A, 216B, 216C, 216D. The first layer 216A may include one or more of Al and Ni. The second layer 216B includes an oxide, nitride, or carbide of one or more of Al, Zn, Mg, Mo, W, Cu, Fe, Si, Ca, Co, Ta, Re and Ni. The third layer 216C also includes an oxide, nitride, or carbide of one or more of Al, Zn, Mg, Mo, W, Cu, Fe, Si, Ca, Co, Ta, Re and Ni, but has a composition differing from that of the second layer 216B. The fourth layer 216D may include one or more of Al, Mn, Fe, Co, and Ni.

The one or more layers 216A, 216B, . . . 216N of the coating 214 may be deposited on the particles 210 using, for example, a chemical vapor deposition (CVD) process or a physical vapor deposition (PVD) process. Such deposition processes optionally may be carried out in a fluidized bed reactor. Further, in some embodiments, the one or more layers 216A, 216B, . . . 216N of the coating 214 may thermally treated (i.e., sintered, annealed, etc.) to promote the formation of a ceramic phase or an intermetallic phase from the various elements present in the coating 214 after the deposition process.

Figure 11:
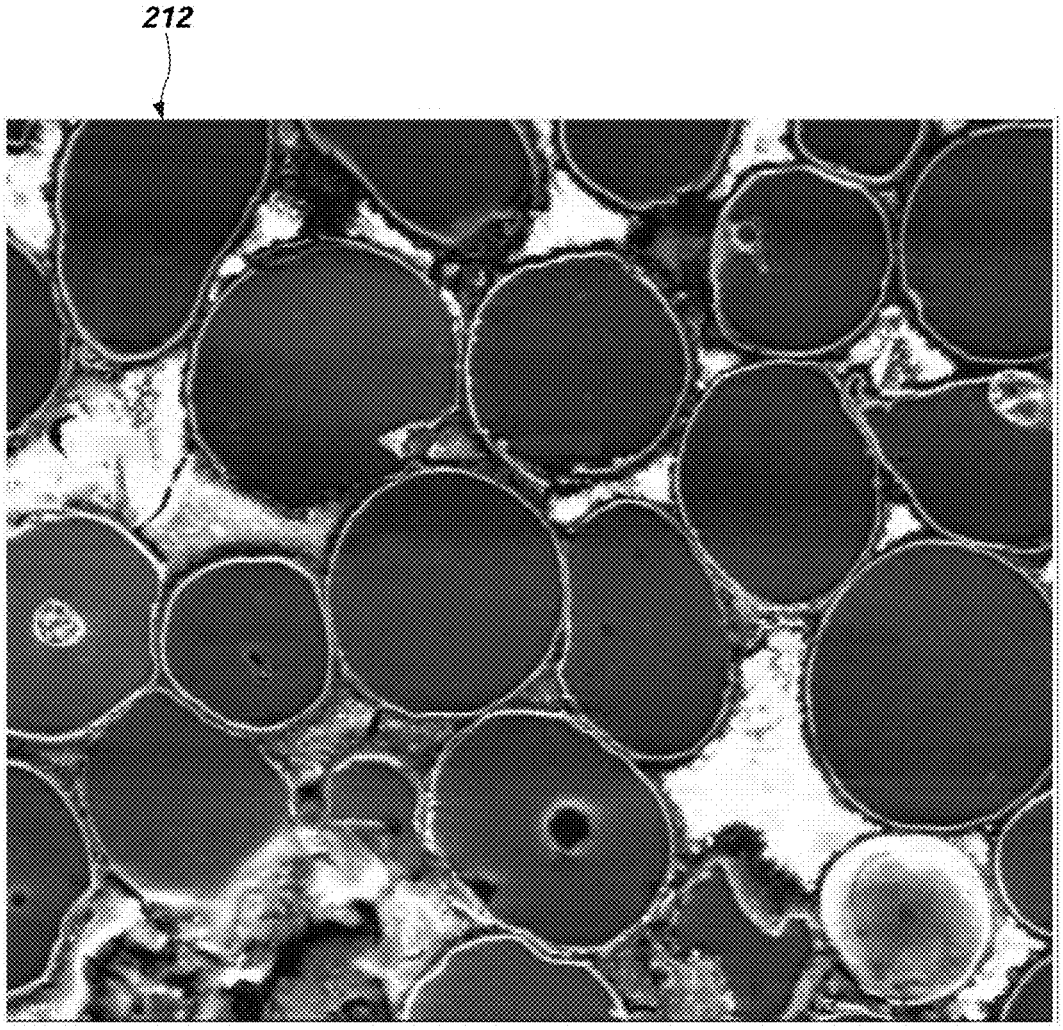
FIG. 11 is a photomicrograph of a plurality of coated metallic particles like that schematically illustrated in FIG. 10.

The coating 214 may have an average total thickness of about two and one-half microns (2.5 μm) or less. For example, the coating 214 may have an average total thickness of between about twenty-five nanometers (25 nm) and about two and one-half microns (2.5 μm). Further, although FIG. 10 illustrates the coating 214 as having an average thickness that is a significant percentage of the diameter of the particle 210, the drawings are not to scale, and the coating 214 may be relatively thin compared to the overall average diameter of the coated particles 212. FIG. 11 is a micrograph illustrating how the coated particles 212 may appear under magnification. As shown therein, the coatings 214, which are the light regions surrounding the particles 210 (the dark shaded regions), may have a thickness that is a relatively small percentage of the diameter of the core particles 210.

Referring again to FIG. 7, after providing the powder including the coated particles 212, the powder including the coated particles 212 may be consolidated in action 206 by pressing and/or heating (e.g., sintering) the powder to form a solid three-dimensional body. The solid three-dimensional body may comprise a billet having a generic shape, such as a block or cylinder. In other embodiments, the solid three-dimensional body may have a near-net shape (e.g., a sphere) like that of the triggering element 114 (FIG. 2) in some embodiments.

For example, the powder including the coated particles 212 may be consolidated by pressing and heating the powder to form the solid three-dimensional body. The pressing and heating processes may be conducted sequentially, or concurrently. For example, in some embodiments, the powder including the coated particles 212 may be subjected to at least substantially isostatic pressure in, for example, a cold isostatic pressing process. In additional embodiments, the powder including the coated particles 212 may be subjected to directionally applied (e.g., uniaxial, biaxial, etc.) pressure in a die or mold. Such a process may comprise a hot-pressing process in which the die or mold, and the coated particles 212 contained therein, are heated to elevated temperatures while applying pressure to the coated particles 212. In some embodiments, a billet may be formed using a cold-isostatic pressing process, after which the billet may be subjected to a hot pressing process in which the billet is further compressed within a heated die or mold to consolidate the coated particles 212.

The consolidation process of action 206 may result in removal of the porosity within the powder, and may result in the formation of the composite material shown in FIGS. 5 and 6 from the coated particles 212 of FIG. 10.

The consolidation process of action 206 may comprise a solid state sintering process, wherein the coated particles 212 are sintered at a sintering temperature $T_S$ that is less than both the melting point $T_P$ of the particles 210 (and the metallic phase 200) and the melting point $T_C$ of the coating 214 (and the corrodible matrix phase 202).

Referring again to FIG. 7, in action 207, the three-dimensional body formed by the consolidation process of action 206 optionally may be machined in action 207 to form the triggering element 114 (FIG. 2) as needed or desirable. For example, one or more of milling, drilling, and turning processes may be used to machine the triggering element 114 as needed or desirable.

Figure 12:
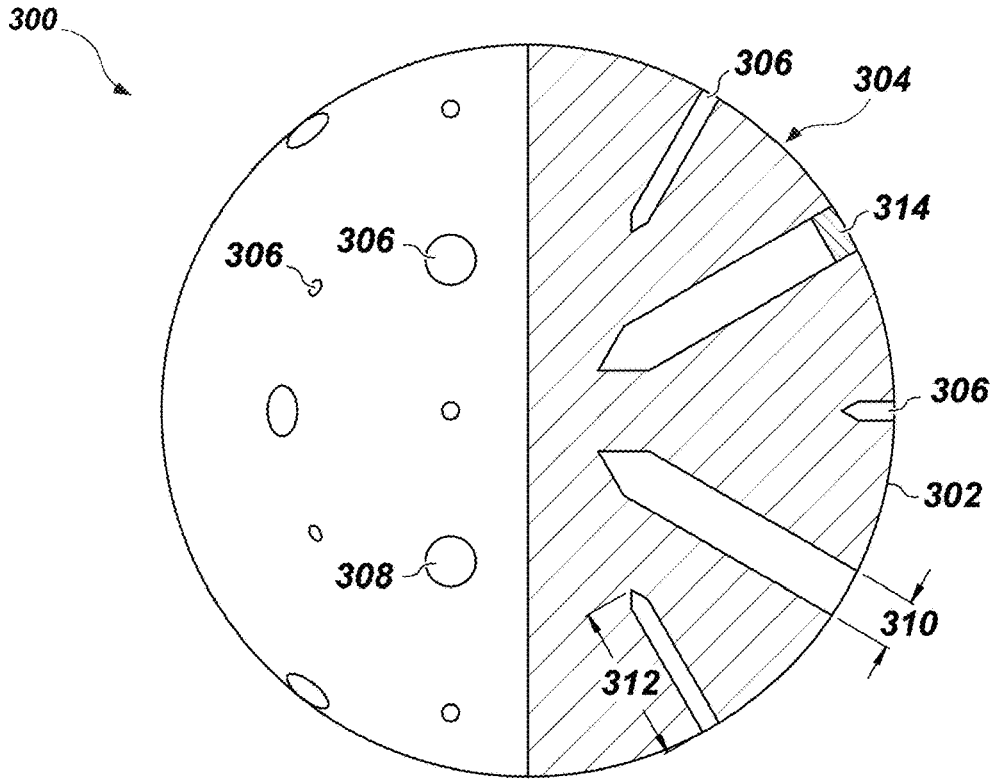
FIG. 12 is a partial cross-sectional view of a triggering element for use with an expandable apparatus in accordance with another embodiment of the present disclosure.

FIG. 12 is a partial cross-sectional view of a triggering element for use with an expandable apparatus. As shown in FIG. 12, the triggering element 300 includes a body 302, illustrated in this embodiment as a ball; however, other embodiments may include other shapes (e.g., a cylinder, an ellipsoid, a polyhedron, etc.). The body 302 may have a surface 304 including one or more perforations 306 formed therein. Dimensions of the perforations 306 such as, for example, cross-sectional area 308, diameter 310 (for perforations that have a circular cross section), and depth 312 are selected to control a rate of intrusion of an environment into the triggering element 300 (e.g., an environment including a fluid such as a salt solution or other wellbore fluids configured to corrode at least a portion of the triggering element 300). By controlling the rate of intrusion of the environment into the body 302 a rate of reaction of the material of the body 302 with the environment can also be controlled, as can be the rate at which the body 302 is weakened to a point wherein it can fail (e.g., due to stress applied thereto, due to the degradation of the body 302, etc.).

In some embodiments, the dimensions 308, 310, 312 of the perforations 306 can be selected to expose portions of the body 302 to the environment upon exposure, such as by submersion of the body 302, into the environment. By varying the depth 312 of the perforations 308, for example, portions of the body 302 located within the body 302, such as near the center, may be exposed to the environment at nearly the same time that portions nearer to the surface 304 are exposed. In such an embodiment, dissolution of the body 302 may be achieved more uniformly over the entire volume of the body 302 providing greater control over a rate of dissolution thereof.

In some embodiments, optional plugs 314 may be sealably engaged with the body 302 in at least one of the perforations 306. The plugs 314 may be configured through, porosity, material selection and adhesion to the body 302, for example, to provide additional control of a rate of exposure of the body 302, via the perforations 306, to the environment.

Figure 13:
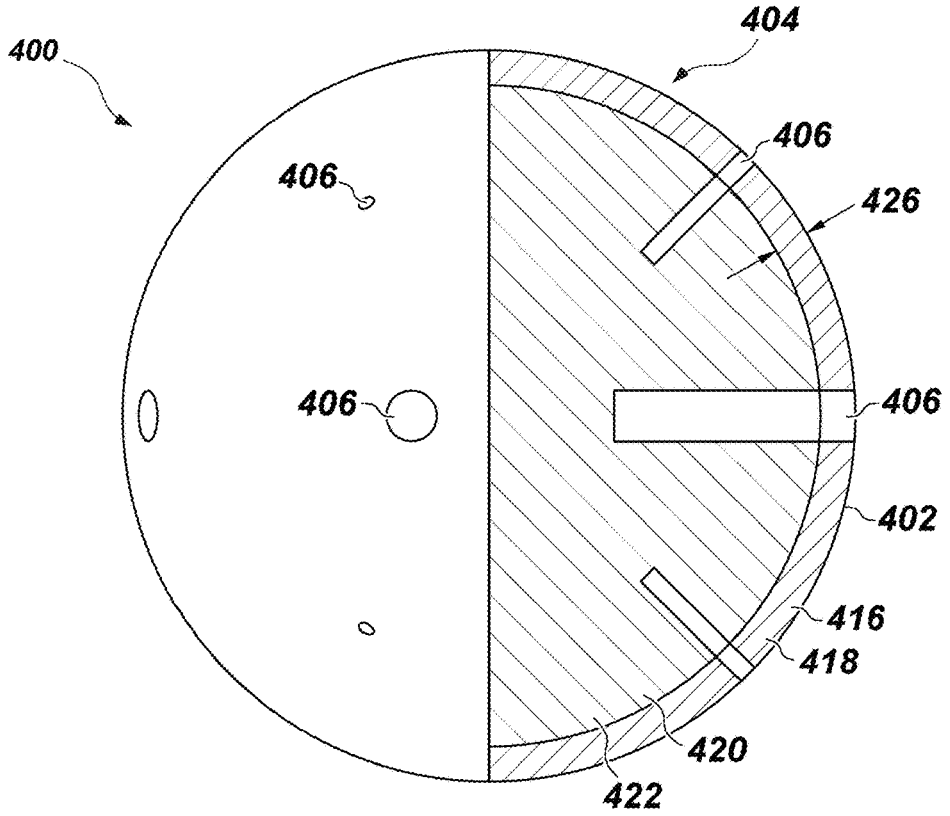
FIG. 13 is a partial cross-sectional view of a triggering element for use with an expandable apparatus in accordance with yet another embodiment of the present disclosure.

Referring to FIG. 13, another embodiment of a triggering element 400 is illustrated. The triggering element 400 may be similar to the triggering element 300 shown and described with reference to FIG. 12. The triggering element 400 has a body 402, also illustrated as a ball, having a surface 404 with perforations 406 formed therethrough. The body 402 has a shell 416 that surrounds a core 420. The shell 416 may be made of a first material 418 and the core 420 may be made of a second material 422. The first material 418 may be relatively inert to the environment and will resist dissolution when exposed to the environment, while the second material 422 may be highly reactive in the environment and will dissolving at a relatively faster rate when exposed to an environment including, for example, salt solutions, elevated temperatures, or combinations thereof. With such material selections, the first material 418 may remain substantially intact and substantially unaffected by the environment found in the downhole environment of the downhole application discussed above. The second material 422, however, will dissolve relatively quickly once a significant portion of the second material 422 of the body 402 is exposed to, for example, a salt solution after the salt solution has penetrated below the shell 416 through the perforations 406 therein.

In some embodiments, the shell 416 may be configured to lack sufficient structural integrity to prevent fracture thereof under anticipated mechanical loads experienced during its intended use when not structurally supported by the core 420. Stated another way, the second material 422 of the core 420, prior to dissolution thereof, supplies structural support to the shell 416. This structural support prevents fracture of the shell 416 during the intended use of the body 402. Consequently, the dissolution of the core 420, upon exposure of the core 420 to the environment, results in a removal of the structural support supplied by the core 420. Once this structural support is removed the shell 416 can fracture into a plurality of pieces of sufficiently small size that they are not detrimental to continued well operations. It should further be noted that the perforations 406 through the shell 416, in addition to allowing the environment to flow therethrough, also weaken the shell 416. In some embodiments, parameters of the shell 416 that contribute to its insufficient strength may include material selection, material properties, and thickness 426.

Figure 14:
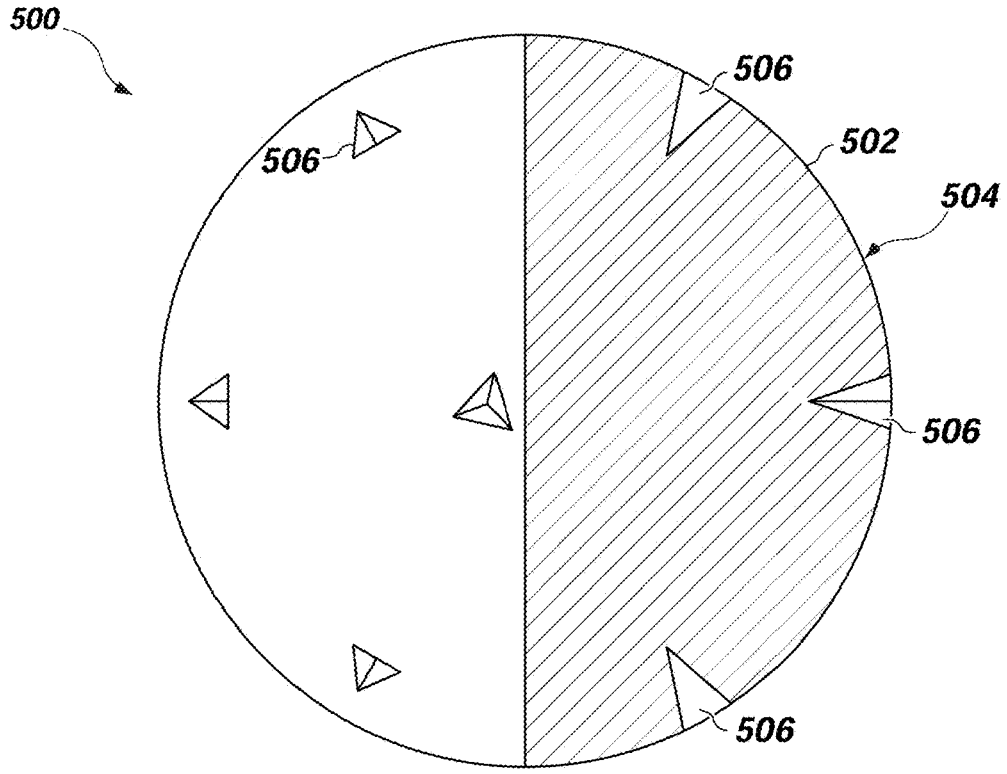
FIG. 14 is a partial cross-sectional view of a triggering element for use with an expandable apparatus in accordance with yet another embodiment of the present disclosure.

FIG. 14 is a partial cross-sectional view of a triggering element for use with an expandable apparatus. The triggering element 500 may be similar to the triggering elements 300, 400 shown and described with reference to FIGS. 12 and 13. As shown in FIG. 14, a body 502 of the triggering element 500 includes a surface 504 having a plurality of stress risers 506. The stress risers 506 illustrated herein are indentations; however, other embodiments may employ stress risers 506 with other configurations (e.g., cracks in the body 502, foreign bodies formed in the body 502 from a material relatively more reactive with an anticipated environment (e.g., salt solution), etc.). Additionally, other embodiments may employ any number of stress risers 506 including embodiments with just a single stress riser 506. The stress risers 506 are configured to concentrate stress at the specific locations of the body 502 where the stress risers 506 are located. This concentrated stress initiates micro-cracks that once nucleated propagate through the body 502 leading to fracture of the body 502. The stress risers 506 can, therefore, control strength of the body and define values of mechanical stress that will result in failure. Additionally, exposure of the body 502 to environments that are reactive with the material of the body 502 accelerates reaction of the body 502, such as chemical reactions, for example, at the locations of the stress risers 506. This accelerated reaction will weaken the body 502 further at the stress riser 506 locations facilitating fracture and dissolution of the triggering element 500.

Figure 15:
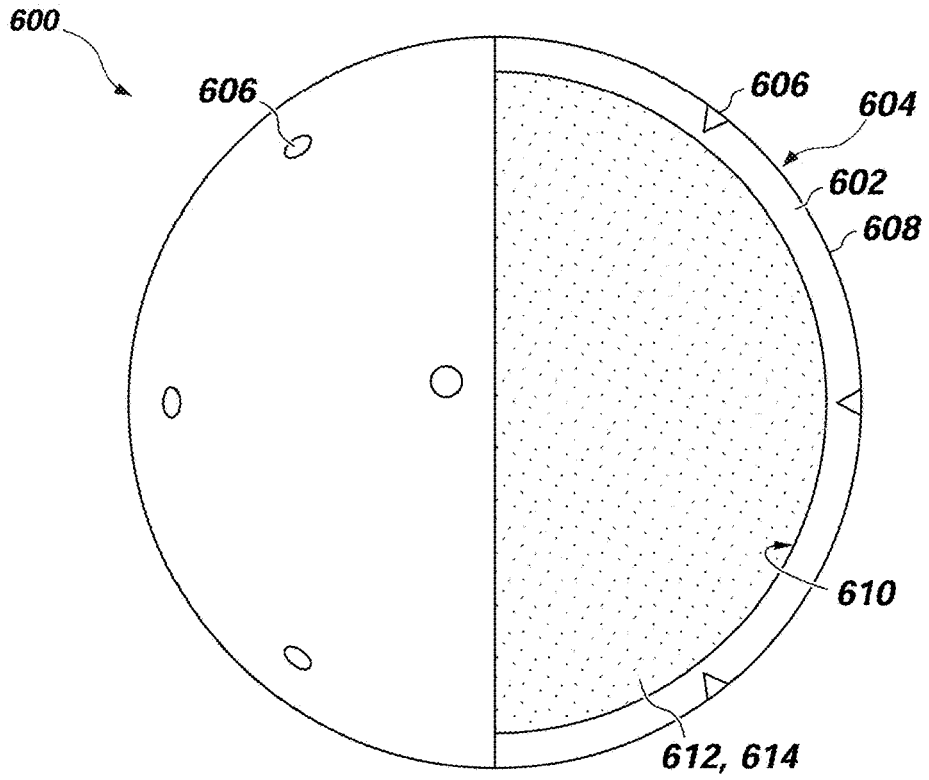
FIG. 15 is a partial cross-sectional view of a triggering element for use with an expandable apparatus in accordance with yet another embodiment of the present disclosure.

FIG. 15 illustrates another embodiment of a triggering element 600 that may be similar to the triggering elements 300, 400, 500 shown and described with reference to FIGS. 12 through 14. The triggering element 600 has a body 602 made of a shell 608 defining a surface 604. The shell 608 has a plurality of stress risers 606 that are shown in this embodiment as conical indentations. The stress risers 606 formed in the shell 608 may not extend radially inwardly of an inner surface 610 of the shell 608. In some embodiments, the body 602 may have a hollow core 614. In other embodiments, the core 614 may be formed from a fluid 612, may a fluidized material, such as a powder, a solid material, etc., each of which may provide some support to the shell 608 while being relatively more reactive with an anticipated environment once the shell 608 is fractured.

In some embodiments, the shell 608 of the triggering element 600 may primarily determine the strength thereof. For example, once micro-cracks form in the shell 608 the compressive load bearing capability is significantly reduced leading to rupture shortly thereafter. Consequently, the stress risers 606 may control timing of strength degradation of the triggering element 600 once the triggering element 600 is exposed to a reactive environment.

Figure 16:
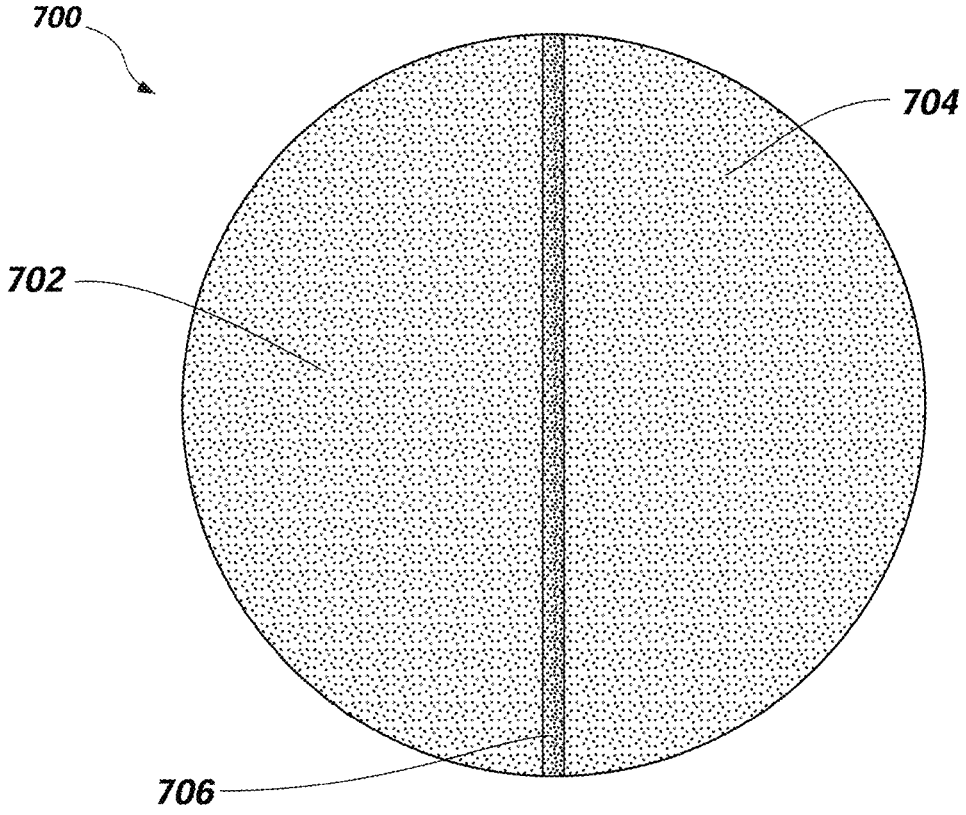
FIG. 16 is a cross-sectional view of a triggering element for use with an expandable apparatus in accordance with yet another embodiment of the present disclosure.

FIG. 16 is a cross-sectional view of a triggering element for use with an expandable apparatus. The triggering element 700 may be similar to the triggering elements 300, 400, 500, 600 shown and described with reference to FIGS. 12 through 15. As shown in FIG. 16, the triggering element 700 may be formed from two or more portions (e.g., portions 702, 704 of a sphere) and an adherent corrodible material 706 adjoining the portions 702, 704. The adherent corrodible material 706 may comprise any of the corrodible materials discussed above. In some embodiments, one or more of the portions 702, 704 may have a perforation (e.g., as described above with reference to FIG. 12) formed therein and extending to the adherent corrodible material 706. As above, when exposed to a selected environment (e.g., a salt solution) the adherent corrodible material 706 may deteriorate. Such deterioration may enable the portions 702, 704 of the triggering element 700, which may be formed from a substantially non-corrodible material, to break apart and pass through an expandable apparatus. It is noted that while the embodiment of FIG. 16 illustrates the triggering element 700 having two sections, other embodiments may include any suitable number of sections (e.g., three sections, four sections, five sections, etc.).

Thus, it will be readily apparent from the foregoing description that the term "corrodible," as used to describe triggering elements of the various embodiments of the disclosure, is employed in its broadest sense. Thus, the term "corrodible" as applied to a triggering element of the present disclosure means and includes a triggering element that is of materials and structure degradable (e.g., via corrosion, dissolution, disintegration, etc.) responsive to initiation, without limitation, of one or more selected chemical, electrochemical, temperature, pressure, or force mechanisms, optionally augmented by structural features of the triggering element configured to enhance degradational response of the triggering element to one or more those mechanisms.

Figure 17:
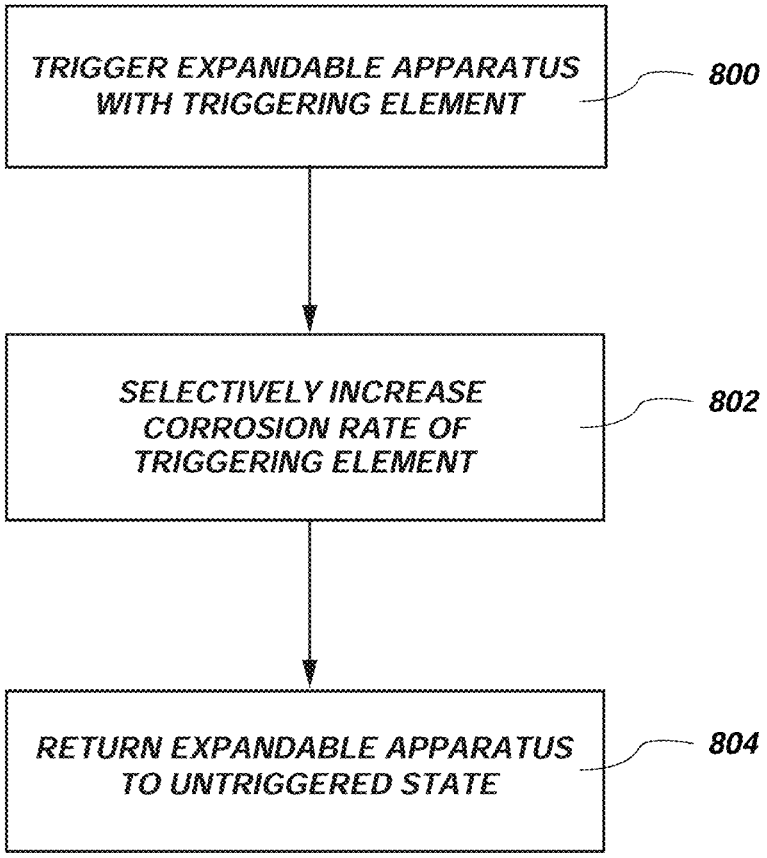
FIG. 17 is a flow chart illustrating an embodiment of a method that may be used to trigger an expandable apparatus like that shown in FIG. 1.

Embodiments of the disclosure also include methods of triggering an expandable apparatus using a triggering element formed from a corrodible composite material. For example, FIG. 17 is a flow chart illustrating an embodiment of a method that may be used to trigger an expandable apparatus (e.g., expandable reamer apparatus 100 with triggering elements 114, 400, 500, 600, 700 (FIGS. 2 and 12 through 16)). In action 800, a triggering element may be placed in the fluid flow path in a drill string and may be seated in a portion of the expandable apparatus (e.g., in the traveling sleeve 112 (FIG. 3)), thereby, triggering the expandable apparatus and extending the blades (e.g., blades 101 (FIG. 1), as discussed above, to perform a downhole operation (e.g., reaming the wellbore, stabilizing a portion of a drill string, etc.).

After the expandable apparatus has been triggered within the wellbore, a rate of corrosion of the triggering element within the expandable apparatus may be selectively increased in accordance with action 802. By way of example and not limitation, a salt and/or acid content within drilling fluid being pumped down the wellbore through the expandable apparatus may be selectively increased (e.g., increasing, commencing, etc.). As previously described, the triggering element of the expandable apparatus may comprise a composite material having at least a portion of its composition that will corrode when exposed to a salt solution (e.g., brine) and/or an acidic solution. Further, the corrosion mechanism may be or include an electrochemical reaction occurring between one or more reagents in the salt solution and/or acidic solution (i.e., a salt or an acid), and one or more elements of a corrodible matrix phase 202 (FIG. 5) of the composite material. As a result of the reaction between the one or more reagents in the salt solution and/or acidic solution and one or more elements of the corrodible matrix phase 202, the corrodible matrix phase 202 may degrade. Thus, the triggering element of the expandable apparatus may be selectively corroded and degraded within the wellbore after using the expandable apparatus for a period of service time in a triggered (e.g., expanded) position.

Figure 18:
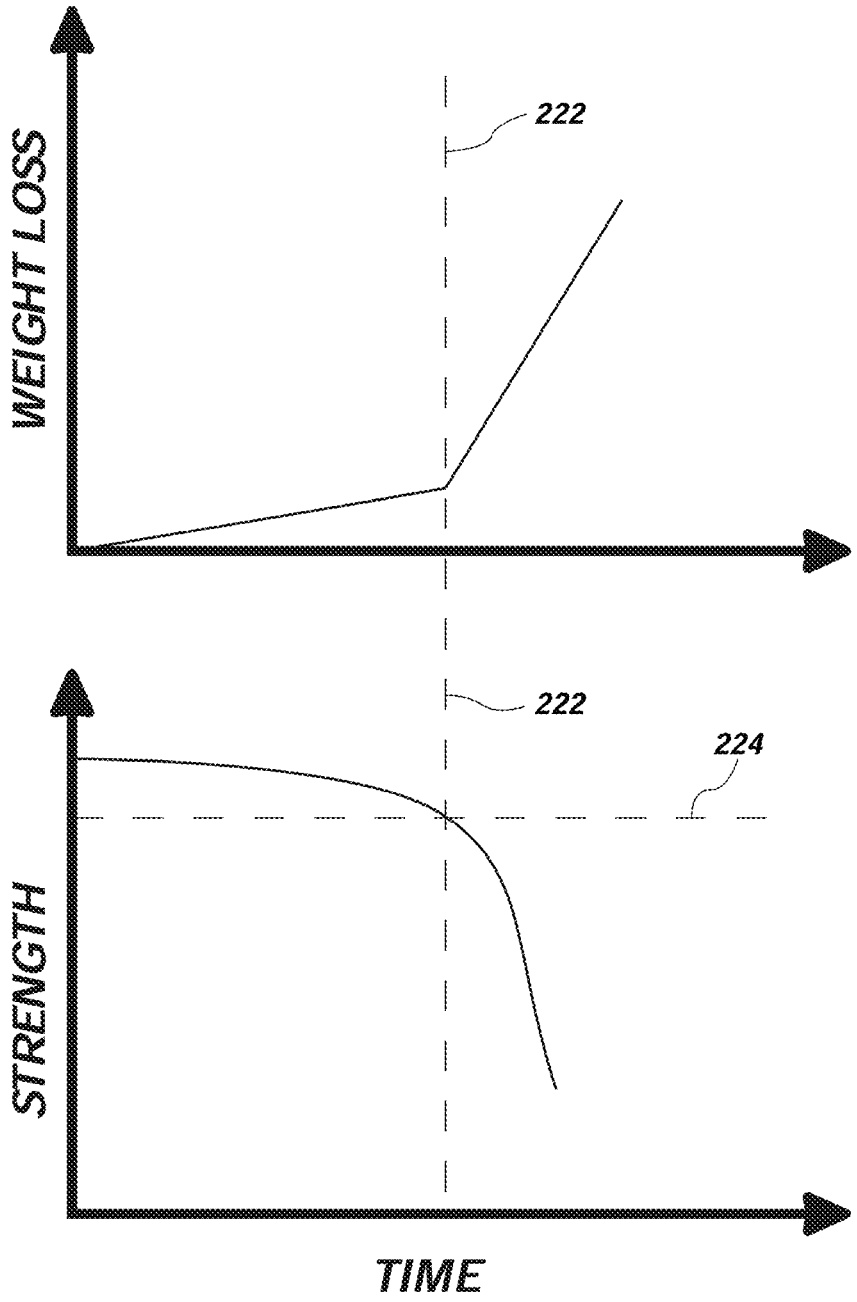
FIG. 18 includes a first graph generally illustrating the weight loss of a triggering element of an expandable apparatus, such as the expandable apparatus of FIG. 1, as a function of service time of the triggering element, and a second graph generally illustrating the strength of the triggering element as a function of the service time of the triggering element.

The selective increase in the rate of corrosion of an expandable apparatus is further illustrated with reference to FIG. 18, which includes a first graph (at the top of FIG. 18) generally illustrating the weight loss of the triggering element of the expandable apparatus as a function of service time of the triggering element, and a second graph (at the bottom of FIG. 18) generally illustrating the triggering element of the expandable apparatus as a function of the service time of the triggering element (e.g., a service time during which the triggering element triggers the expandable apparatus). An intended time 222 is indicated in FIG. 18 by a vertically extending dashed line. The intended time 222 may be a period of time over which the triggering element of the expandable apparatus should remain sufficiently strong so as to trigger the expandable apparatus that is to be used in a wellbore (e.g., to drill, ream, stabilize, or combinations thereof). The rate at which weight is lost from the triggering element of the expandable apparatus prior to the intended time 222 (due, for example, to wear, erosion, and corrosion) is represented by the slope of the line to the left of the intended time 222. As shown in FIG. 18, after the intended time 222, the rate at which the triggering element corrodes within the expandable apparatus may be selectively increased, such that the rate at which weight is lost from the triggering element is higher, as represented by the higher slope of the line to the right of the intended time 222. For example, a salt content and/or an acid content in the drilling fluid may be selectively increased at the intended time 222 and maintained at a higher concentration thereafter until the triggering element has sufficiently corroded.

The strength of the triggering element of the expandable reamer apparatus will decrease as weight is lost from the triggering element of the expandable reamer apparatus due to wear, erosion, and/or corrosion. As previously described, it may be desirable to maintain a strength of the triggering element of the expandable reamer apparatus above a threshold strength 224, until reaching the intended time 222. By way of example and not limitation, the threshold strength 224 may be a compressive yield strength of at least about 250 MPa, of even at least about 300 MPa. Once the intended time 222 is reached, however, it may be desirable to decrease the strength of the triggering element below the threshold strength 224 so as to facilitate removal of the triggering element from the expandable apparatus (e.g., from the traveling sleeve 112 (FIG. 3)). Thus, due to the increased rate of corrosion of the triggering element, additional weight may be lost from the triggering element, resulting in a decrease in the strength of the triggering element as shown in FIG. 18.

Referring again to FIG. 17, after corroding the triggering element of the expandable reamer apparatus, in action 804, the triggering element may be removed from the expandable apparatus (e.g., from the traveling sleeve 112 (FIG. 3)). Stated in another way, as the triggering element degrades sufficiently, it will be disengaged from the expandable apparatus enabling the expandable apparatus to return to a non-triggered state. For example, portion of the at least a partially corroded triggering element may pass through the seat 119 of the traveling sleeve 112 and out of the expandable reamer apparatus 100 (FIG. 3). Removing the triggering element may enable the blades 101 (FIG. 1) to retract and may enable drilling fluid to flow through the longitudinal bore 110 of the tubular body 102 (FIG. 2) without expanding the blades again. Thus, embodiments of the present disclosure may be employed to enable an expandable apparatus to be triggered more than one time (e.g., without being removed from the wellbore). For example, a triggering element may be introduced into the expandable apparatus to trigger the expandable apparatus (e.g., extending the blades 101 (FIG. 1) of an expandable apparatus). The triggering element may then be subsequently removed, by corrosion thereof, from the expandable apparatus returning the expandable apparatus to a non-triggered state. In a non-triggered state, fluid flow may pass through the expandable apparatus without moving the blades to an extended position. The expandable apparatus may then be triggered again when desirable (e.g., by repeating actions 800, 802, and 804) and so on.

Those of ordinary skill in the art will recognize and appreciate that the disclosure is not limited by the certain embodiments described hereinabove. Rather, many additions, deletions and modifications to the embodiments described herein may be made without departing from the scope of the disclosure, which is defined by the appended claims and their legal equivalents. In addition, features from one embodiment may be combined with features of another embodiment while still being encompassed within the scope of the disclosure as contemplated by the inventors.

What is claimed is:

1. A method of forming a triggering element for an expandable apparatus for use in a subterranean borehole, comprising:

consolidating a powder comprising metallic particles, at least some of the metallic particles being coated with multiple, differing layers of at least one of a ceramic and an intermetallic compound to form a solid three-dimensional body comprising a discontinuous metallic phase dispersed within a corrodible matrix phase, the metallic phase formed by the metallic particles, the corrodible matrix phase comprising the at least one of a ceramic and an intermetallic compound of the coating on the metallic particles;

selecting a first layer of the coating to at least partially enhance a metallurgical bond to the at least some of the metallic particles and to at least partially limit interdiffusion between the at least some of the metallic particles and the first layer;

selecting a second layer of the coating to promote sintering between adjacent coated particles of the metallic particles; and sizing and configuring the solid three-dimensional body to be received in a seat formed within the expandable apparatus.

2. The method of claim 1, further comprising forming a majority of the corrodible matrix phase with the at least one of a ceramic and an intermetallic compound, a majority of the at least one of the ceramic and the intermetallic compound comprising magnesium and at least one of aluminum and nickel.

3. The method of claim 1, further comprising forming a majority of the at least one of the ceramic and the intermetallic compound with magnesium and at least one of aluminum and nickel.

4. The method of claim 1, further comprising forming a majority of the corrodible matrix phase with magnesium and at least one of aluminum and nickel.

5. The method of claim 1, further comprising constituting the metallic particles with at least one of a metal or a metal alloy.

6. The method of claim 1, further comprising forming the solid three-dimensional body to exhibit a compressive yield strength of at least about 250 MPa.

7. The method of claim 1, further comprising constituting the discontinuous metallic phase with nanoparticles of at least one of a metal or a metal alloy.

8. The method of claim 1, further comprising constituting the discontinuous metallic phase with at least one of a commercially pure magnesium or a magnesium alloy.

9. The method of claim 1, further comprising forming the corrodible matrix phase with at least one of oxygen, magnesium oxide, aluminum oxide, or nickel oxide.

10. The method of claim 1, further comprising formulating the corrodible matrix phase to corrode in at least one of a brine solution or an acidic solution.

11. A method of forming a triggering element for an expandable apparatus for use in a subterranean borehole, comprising:

forming a solid three-dimensional body comprising a discontinuous metallic phase dispersed within a corrodible matrix phase to define at least a portion of the triggering element, the metallic phase formed by the metallic particles coated with at least one of a ceramic and an intermetallic compound, the forming the solid three-dimensional body comprising:

forming at least two or more portions of a relatively non-corrodible material as compared to the discontinuous metallic phase dispersed within the corrodible matrix phase of the solid three-dimensional body; and binding the at least two or more portions of a relatively non-corrodible material together with the discontinuous metallic phase dispersed within the corrodible matrix phase;

formulating the corrodible matrix phase to corrode in at least one of a brine solution or an acidic solution; and sizing the triggering element to be received in a seat formed within the expandable apparatus.

12. The method of claim 11, further comprising forming a shell defining an outer surface of the triggering element comprising a shell material around a core material comprising the solid three-dimensional body, wherein the shell material is formed from a relatively non-corrodible material as compared to the core material.

13. The method of claim 12, further comprising defining at least one perforation in the outer surface of the triggering element extending through the shell and into the core by at least some depth.

14. The method of claim 13, further comprising dimensioning the at least one perforation to control a rate of intrusion of the at least one of the brine solution or the acidic solution into at least a portion of the triggering element.

15. The method of claim 11, further comprising:

defining at least one stress riser extending through an outer surface of the triggering element and into the triggering element; and configuring the at least one stress riser to concentrate stress in order to accelerate structural degradation of the triggering element.

16. The method of claim 11, further comprising:

forming a shell defining an outer surface of the triggering element around the solid three-dimensional body;

defining at least one stress riser extending through the outer surface of the triggering element and into the shell of the triggering element; and configuring the at least one stress riser to concentrate stress in order to accelerate structural degradation of the triggering element.

17. The method of claim 16, forming the shell from a relatively non-corrodible material as compared to material of the solid three-dimensional body.

18. A method of forming a triggering element for an expandable apparatus for use in a subterranean borehole, comprising:

consolidating a powder comprising metallic particles coated with at least one of a ceramic and an intermetallic compound to at least partially define a drop ball comprising a discontinuous metallic phase dispersed within a corrodible matrix phase, the metallic phase formed by the metallic particles, the corrodible matrix phase comprising the at least one of a ceramic and an intermetallic compound of the coating on the metallic particles, the discontinuous metallic phase comprising a metal or metal alloy, a majority of the corrodible matrix phase comprising at least one of a ceramic and an intermetallic compound;

selecting a first layer of the coating on at least some of the metallic particles and to at least partially limit interdiffusion between the at least some of the metallic particles and the first layer;

selecting a second layer of the coating on the at least some of the metallic particles to promote sintering between adjacent coated particles of the metallic particles; and sizing the drop ball to be received in a seat formed within the expandable apparatus.

* * * * *